US005245662A

United States Patent [19]

Taniguchi et al.

[11] Patent Number: 5,245,662

[45] Date of Patent: Sep. 14, 1993

[54] SPEECH CODING SYSTEM

[75] Inventors: Tomohiko Taniguchi, Yokohama, Japan; Mark Johnson, Cambridge, Mass.

[73] Assignee: Fujitsu Limited, Kawasaki, Japan

[21] Appl. No.: 716,882

[22] Filed: Jun. 18, 1991

[30] Foreign Application Priority Data

Jun. 18, 1990 [JP] Japan ..... 2-161042

[51] Int. Cl.[5] ..... G10L 5/00

[52] U.S. Cl. ..... 381/36; 395/2

[58] Field of Search ..... 381/31-36; 395/2

[56] References Cited

PUBLICATIONS

Gerson, et al., "Vector Sum Excited, etc.", Proceedings, ICASSP 90, 1990 International Conference on Acoustics, Speech, and Signal Processing, Apr. 3-6, 1990, IEEE Processing Society, pp. 461-464.

Advances in Speech Coding, (IEEE Workship on Speech Coding for Telecommunications), Vancouver, Sep. 5-8, 1989, "An Efficient Variable-Bit-Rate Low-Delay CELP (VBR-LD-CELP) Coder", W. Be'ery et al., pp. 37-46.

ICASSP'87, (1987 International Conference on Acoustics, Speech and Signal Processing), Dallas, Tex., Apr. 6-9, 1987, vol. 4, "A Comparision of Some Algebraic Structures for CELP Coding of Speech", J. P. Adoul et al., pp. 1953-1956.

ICASSP'89, (1989 International Conference on Acoustics, Speech, and Signal Processing), Glasgow, May 23-26, 1989, vol. 1, "Fast CELP Coding Based on the Barnes-Wall Lattice in 16 Dimensions", C. Lamblin et al., pp. 61-64.

ICASSP'89, (1989 International Conference on Acoustics, Speech, and Signal Processing), Glasgow, May 23-26, 1989, vol. 1, "On Improving Vector Excitation Coders Through the Use of Spherical Lattice Codebooks", M. A. Ireton et al., pp. 57-60.

ICASSP'90, (1990 International Conference on Acoustics, Speech, and Signal Processing), Albuquerque, N.M., Apr. 3-6, 1990, vol. 1, "Optimal and Sub-Optimal Algorithms for Selecting the Excitation in Linear Predictive Coders", P. Dymarski et al., pp. 485-488.

WO-A-9 101 545 (Motorola Inc.).

*Primary Examiner*—Emanuel S. Kemeny

*Attorney, Agent, or Firm*—Staas & Halsey

[57] ABSTRACT

A speech coding system operated under a known code-excited linear prediction (CELP) coding method. The CELP coding is achieved by selecting an optimum pitch vector P from an adaptive codebook and the corresponding first gain and, at the same time, selecting an optimum code vector from a sparse-stochastic codebook and the corresponding second gain. Special code vectors are loaded in the sparse-stochastic codebook, which code vectors are hexagonal lattice code vectors each consisting of a zero vector with one sample set to +1 and another sample set to −1.

10 Claims, 22 Drawing Sheets

Fig. 16A $$AP = \begin{bmatrix} b_1 \\ b_2 \\ \vdots \\ b_N \end{bmatrix}$$

Fig. 16B $$(AP)^{TR} = \begin{bmatrix} b_N \\ \vdots \\ b_2 \\ b_1 \end{bmatrix}$$

Fig. 16C $$A(AP)^{TR} = \begin{bmatrix} d_N \\ \vdots \\ d_2 \\ d_1 \end{bmatrix}$$

Fig. 16D $$W = \begin{bmatrix} d_1 \\ d_2 \\ \vdots \\ d_N \end{bmatrix} = {}^{t}AAP$$

Fig. 17A $$ {}^{t}A = \begin{pmatrix} a_1 & a_2 & \cdots & a_N \\ 0 & a_1 & \cdots & a_{N-1} \\ \cdots & & \cdots & \cdots \\ 0 & 0 & \cdots & a_1 \end{pmatrix} $$

Fig. 17B $$ AP = \begin{pmatrix} b_1 \\ b_2 \\ \vdots \\ b_N \end{pmatrix} $$

Fig. 17C $$ {}^{t}AAP = \begin{pmatrix} a_1 * b_1 + a_2 * b_2 + \cdots + a_N * b_N \\ a_1 * b_2 + \cdots + a_{N-1} * b_N \\ \cdots \\ a_1 * b_N \end{pmatrix} $$

SPEECH CODING SYSTEM

BACKGROUND OF THE INVENTION

1. Field of the Invention

The present invention relates to a speech coding system, more particularly to a speech coding system which performs a high quality compression of speech information signals using a vector quantization technique.

Recently in, for example, intra-company communication systems and digital mobile radio communication systems, a vector quantization method of compressing speech information signals while maintaining the speech quality is employed. According to the vector quantization method, first a reproduced signal is obtained by applying a prediction weighting to each signal vector in a codebook, and then an error power between the reproduced signal and an input speech signal is evaluated to determine a number, i.e., index, of the signal vector which provides a minimum error power. Nevertheless a more advanced vector quantization method is now needed to realize a greater compression of the speech information.

2. Description of the Related Art

A well known typical high quality speech coding method is a code-excited linear prediction (CELP) coding method, which uses the aforesaid vector quantization. The conventional CELP coding is known as sequential optimization CELP coding or simultaneous optimization CELP coding. These typical CELP codings will be explained in detail hereinafter.

As will be understood later, a gain (b) optimization for each vector of an adaptive codebook and a gain (g) optimization for each vector of a stochastic codebook are carried out sequentially and independently under the sequential optimization CELP coding, and are carried out simultaneously under the simultaneous optimization CELP coding.

The simultaneous optimization CELP is superior to the sequential optimization CELP coding from the view point of the realization of high quality speech reproduction, but the simultaneous optimization CELP coding has a drawback in that the computation amount becomes larger than that of the sequential optimization CELP coding.

Namely, the problem with the CELP coding lies in the massive amount of digital calculations required for encoding speech, which makes it extremely difficult to conduct speech communication in real time. Theoretically, the realization of such a speech coding apparatus enabling real time speech communication is possible, but a supercomputer would be required for the above digital calculations, and accordingly in practice it would be impossible to obtain compact (handy type) speech coding apparatus.

To overcome this problems, the use of a sparse-stochastic codebook which stores therein, as white noise, a plurality of thinned out code vectors has been proposed, and this effectively reduces the calculation amount.

SUMMARY OF THE INVENTION

The object of the present invention is to provide a speech coding system which is operated with an improved sparse-stochastic codebook, as this use of an improved sparse-stochastic codebook makes it possible to reduce the digital calculation amount drastically.

To attain the above-mentioned object, the sparse-stochastic codebook is loaded with code vectors formed as multi-dimensional polyhedral lattice vectors each consisting of a zero vector with one sample set to +1 and another sample set to −1.

BRIEF DESCRIPTION OF THE DRAWINGS

The above object and features of the present invention will be more apparent from the following description of the preferred embodiments with reference to the accompanying drawings, wherein:

FIGS. 16A, 16B, 16C and 16D depict an embodiment of the arithmetic processing means shown in FIG. 15A in more detail and from a mathematical viewpoint;

FIGS. 17A, 17B and 17C depict an embodiment of the arithmetic processing means shown in FIG. 15, more specifically and mathematically;

DESCRIPTION OF THE PREFERRED EMBODIMENTS

Before describing the embodiments of the present invention, the related art and the disadvantages thereof will be described with reference to the related figures.

Figure 1:
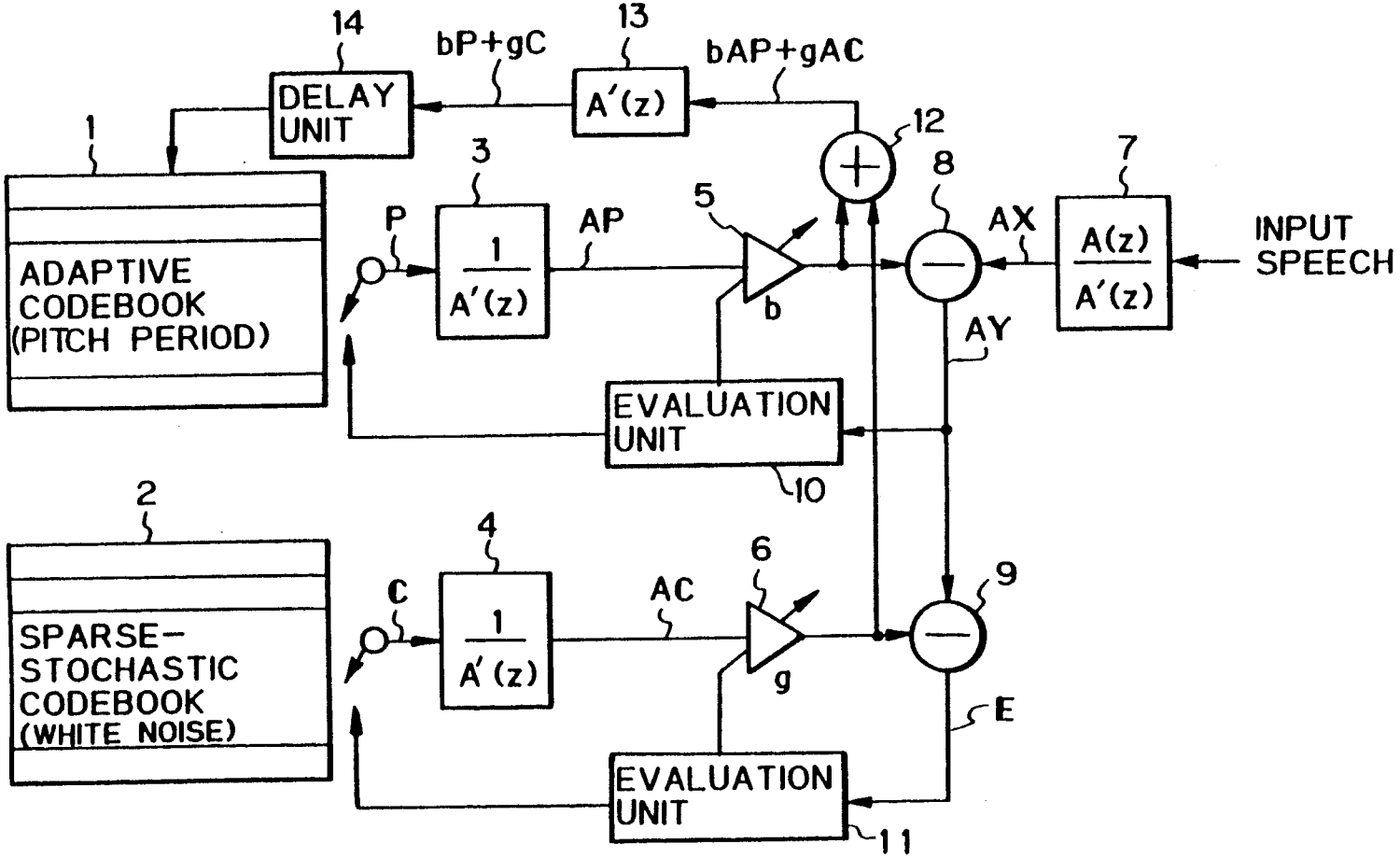
FIG. 1 is a block diagram of a known sequential optimization CELP coding system.
Figure 2:
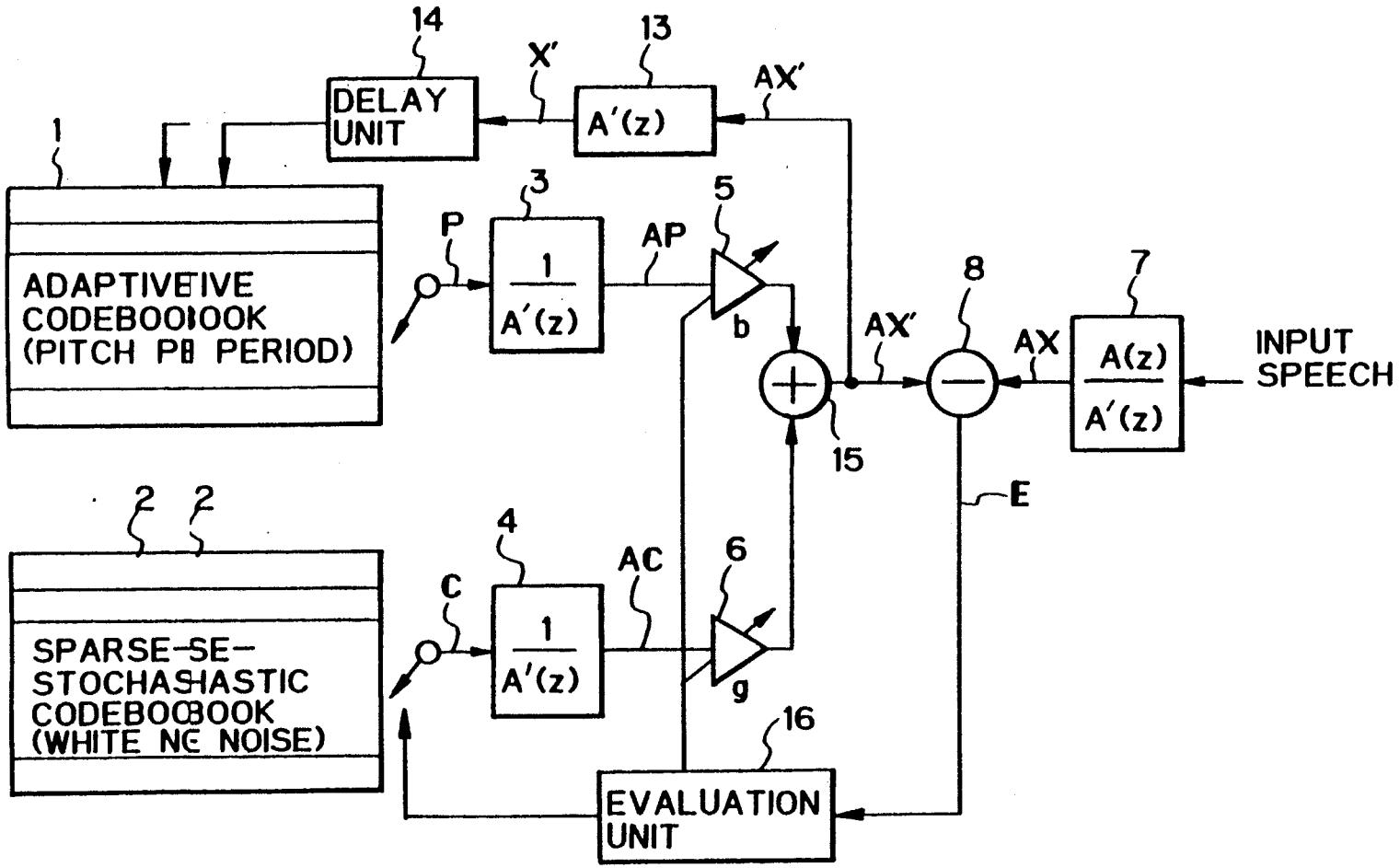
FIG. 2 is a block diagram of a known simultaneous optimization CELP coding system.

FIG. 1 is a block diagram of a known sequential optimization CELP coding system and FIG. 2 is a block diagram of a known simultaneous optimization CELP coding system. In FIG. 1, an adaptive codebook 1 stores therein N-dimensional pitch prediction residual vectors corresponding to N samples delayed by a pitch period of one sample. A sparse-stochastic codebook 2 stores therein $2^m$-pattern each 1 of which code vectors is created by using N-dimensional white noise corresponding to N samples similar to the above samples. In the figure, the codebook 2 is represented by a sparse-stochastic codebook in which some sample data, in each code vector, having a magnitude lower than a predetermined threshold level, e.g., N/4 samples among N samples is replaced by zero. Therefore, the codebook is called a sparse (thinning)-stochastic codebook. Each code vector is normalized such that a power of the N-dimensional elements becomes constant.

First, each pitch prediction residual vector P of the adaptive codebook 1 is perceptually weighted by a perceptual weighting linear prediction synthesis filter 3 indicated as 1/A'(Z), where A'(Z) denotes a perceptual weighting linear prediction analysis filter. The thus produced pitch prediction vector AP is multiplied by a gain b at a gain amplifier 5, to obtain a pitch prediction reproduced signal vector bAP.

Thereafter, both the pitch prediction reproduced signal vector bAP and an input speech signal vector AX, which has been perceptually weighted at a perceptual weighting filter 7 indicated as A(Z)/A'(Z) (where, A(Z) denotes a linear prediction analysis filter), are applied to a subtracting unit 8 to find a pitch prediction error signal vector AY therebetween. An evaluation unit 10 selects an optimum pitch prediction residual vector P from the codebook 1 for every frame such that the power of the pitch prediction error signal vector AY is at a minimum, according to the following equation (1). The unit 10 also selects the corresponding optimum gain b.

$$|AY|^2 = |AX - bAP|^2 \quad (1)$$

Further, each code vector C of the white noise sparse-stochastic codebook 2 is similarly perceptually weighted at a linear prediction reproducing filter 4 to obtain a perceptually weighted code vector AC. The vector AC is multiplied by the gain g at a gain amplifier 6, to obtain a linear prediction reproduced signal vector gAC.

Both the linear prediction reproduced signal vector gAC and the above-mentioned pitch prediction error signal vector AY are applied to a subtracting unit 9, to find an error signal vector E therebetween. An evaluation unit 11 selects an optimum code vector C from the codebook 2 for every frame, such that the power of the error signal vector E is at a minimum, according to the following equation (2). The unit 11 also selects the corresponding optimum gain g.

$$E|^2 = |AY - gAC|^2 \quad (2)$$

The following equation (3) can be obtained by the above-recited equations (1) and (2).

$$E|^2 = |AY - bAP - gAC|^2 \quad (3)$$

Note that the adaptation of the adaptive codebook 1 is performed as follows. First, bAP +gAC is found by an adding unit 12, the thus found value is analyzed to find bP+gC at a perceptual weighting linear prediction analysis filter (A'(Z)) 13, the output from the filter 13 is then delayed by one frame at a delay unit 14, and the thus-delayed frame is stored as a next frame in the adaptive codebook 1, i.e., a pitch prediction codebook.

As mentioned above, the gain b and the gain g are controlled separately under the sequential optimization CELP coding system shown in FIG. 1. Contrary, to this, in the simultaneous optimization CELP coding system of FIG. 2, first, bAP and gAC are added by an adding unit 15 to find $$AX' = bAP + gAC,$$

and the input speech signal perceptually weighted by the filter 7, i.e., AX, and the aforesaid AX', are applied to the subtracting unit 8 to find an error signal vector E according to the above-recited equation (3). An evaluation unit 16 selects a code vector C from the sparse-stochastic codebook 2, which code vector C can minimize the power of the vector E. The evaluation unit 16 also simultaneously controls the selection of the corresponding optimum gains b and g.

Note that the adaptation of the adaptive codebook 1 in the above case is similarly performed with respect to AX', which corresponds to the output of the adding unit 12 shown in FIG. 1.

Figure 3:
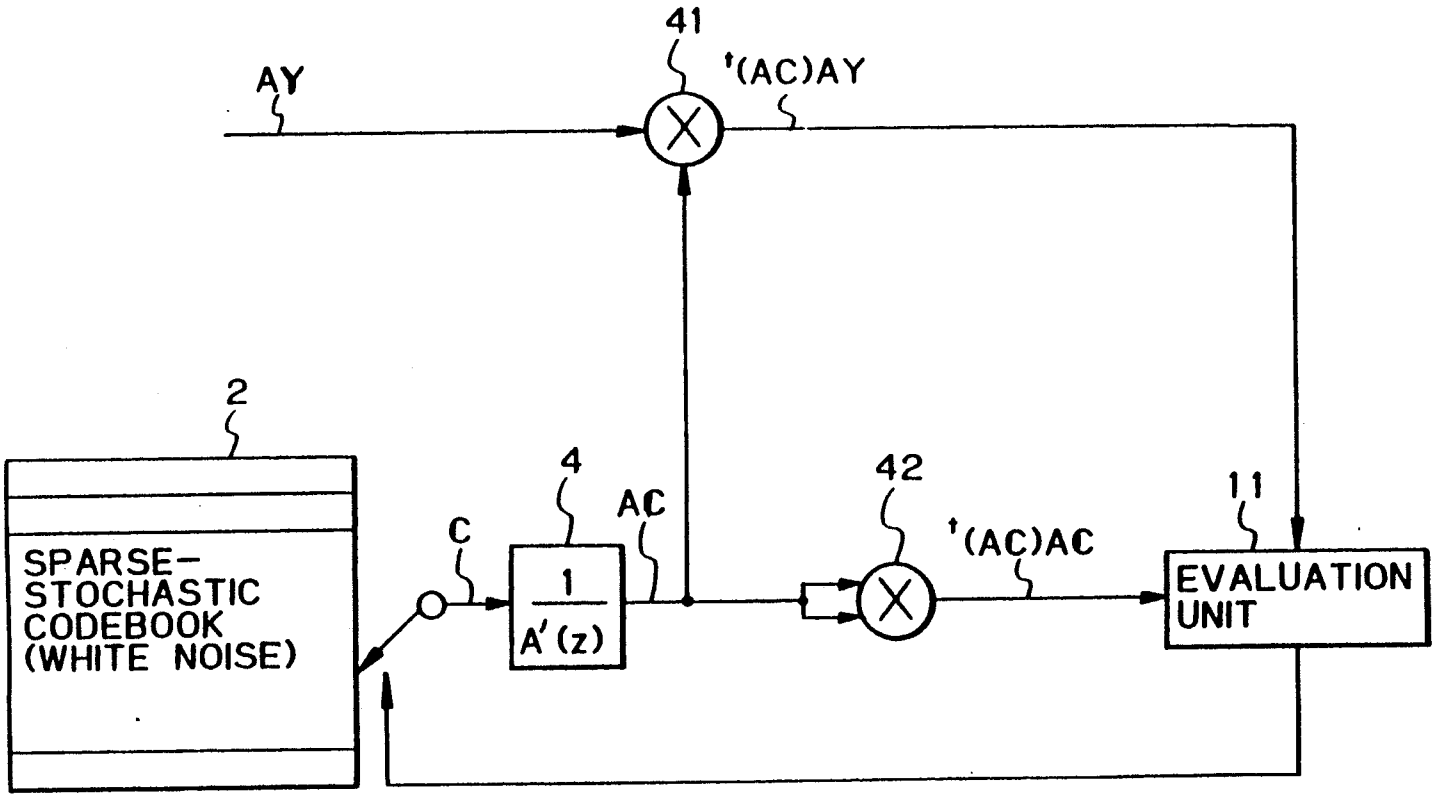
FIG. 3 is a block diagram expressing conceptually an optimization algorithm under the sequential optimization CELP coding method.
Figure 4:
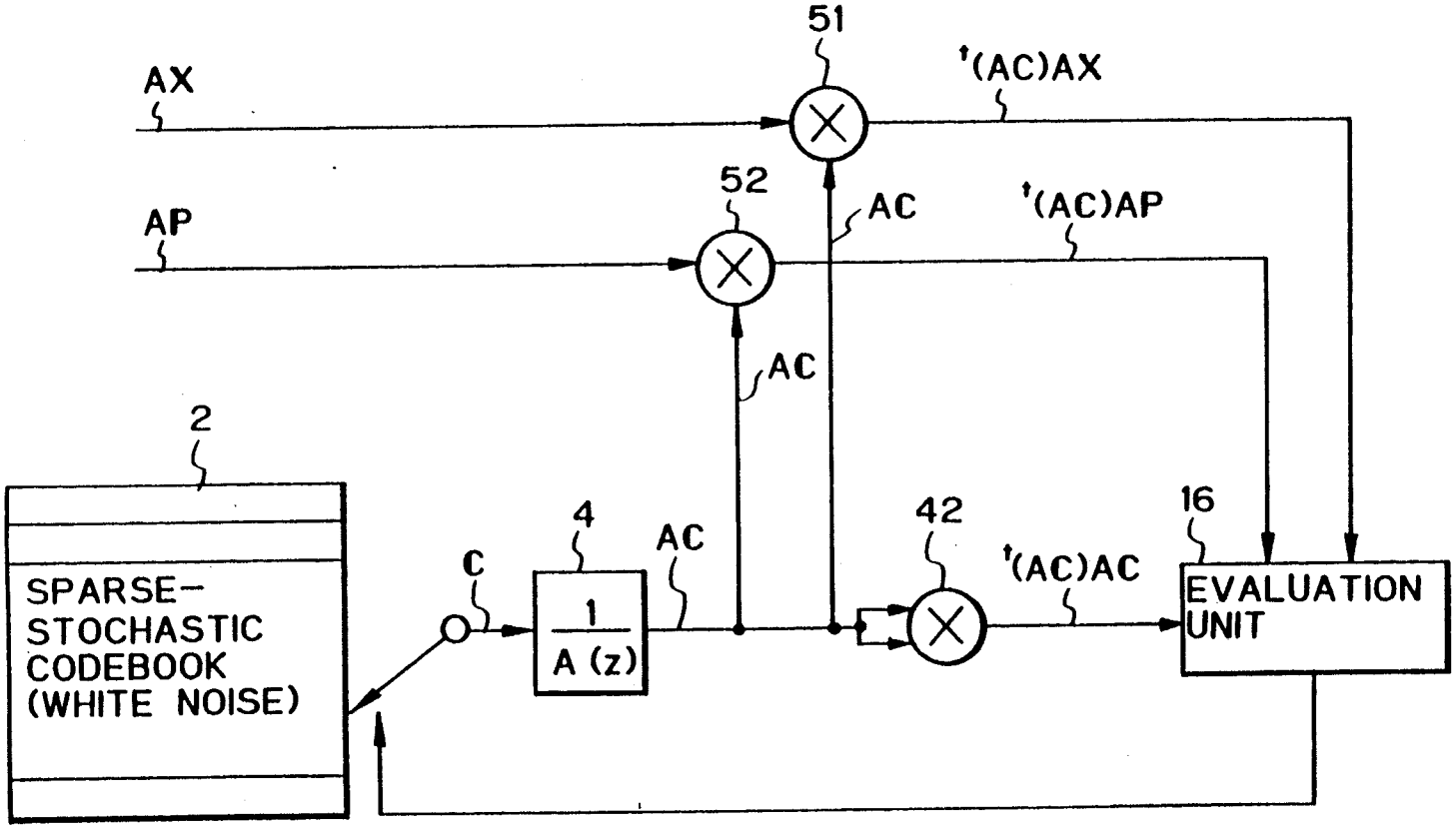
FIG. 4 is a block diagram expressing conceptually an optimization algorithm under the simultaneous optimization CELP coding method.

The gains b and g are depicted conceptually in FIGS. 1 and 2, but actually are optimized in terms of the code vector (C) given from the sparse-stochastic codebook 2, as shown in FIG. 3 or FIG. 4.

Namely, in the case of FIG. 1, based on the above-recited equation (2), the gain g which minimizes the power of the vector E is found by partially differentiating the equation (2), such that $$\begin{aligned} 0 &= \delta(|AY - gAC|^2)/\delta g \\ &= 2\,{}^t(-AC)(AY - gAC) \\ &\text{and} \\ g &= {}^t(AC)AY/{}^t(AC)AC \end{aligned} \quad (4)$$

is obtained, where the symbol "t" denotes an operation of a transpose.

FIG. 3 is a block diagram conceptually expressing an optimization algorithm under the sequential optimization CELP coding method and FIG. 4 is a block diagram for conceptually expressing an optimization algorithm under the simultaneous optimization CELP coding method.

Referring to FIG. 3, a multiplying unit 41 multiplies the pitch prediction error signal vector AY and the code vector AC, which is obtained by applying each code vector C of the sparse-codebook 2 to the perceptual weighting linear prediction synthesis filter 4 so that a correlation value $$^t(AC)AY$$

therebetween is generated. Then the perceptually weighted and reproduced code vector AC is applied to a multiplying unit 42 to find the autocorrelation value thereof, i.e., $$^t(AC)AC.$$

Then, the evaluation unit 11 selects both the optimum code vector C and the gain g which can minimize the power of the error signal vector E with respect to the pitch prediction error signal vector AY according to the above-recited equation (4), by using both of the correlation values $$^t(AC)AY \text{ and } ^t(AC)AC.$$

Further, in the case of FIG. 2 and based on the above-recited equation (3), the gain b and the gain g which minimize the power of the vector E are found by partially differentiating the equation (3), such that $$g = [^t(AP)AP\ ^t(AC)AX - {}^t(AC)AP\ ^t(AP)AX]/e \quad (5)$$
$$b = [^t(AC)AC\ ^t(AP)AX - {}^t(AC)AP\ ^t(AC)AX]/e$$
where
$$e = {}^t(AP)AP\ ^t(AC)AC - ({}^t(AC)AP)^2$$

stands.

Then, in FIG. 4, both the perceptually weighted input speech signal vector AX and the reproduced code vector AC, given by applying each code vector C of the sparse-codebook 2 to the perceptual weighting linear prediction reproducing filter 4, are multiplied at a multiplying unit 51 to generate the correlation value $$^t(AC)AX$$

therebetween. Similarly, both the perceptually weighted pitch prediction vector AP and the reproduced code vector AC are multiplied at a multiplying unit 52 to generate the correlation value $$^t(AC)AP.$$

At the same time, the autocorrelation value $$^t(AC)AC$$

of the reproduced code vector AC is found at the multiplying unit 42.

Then the evaluation unit 16 simultaneously selects the optimum code vector C and the optimum gains b and g which can minimize the error signal vector E with respect to the perceptually weighted input speech signal vector AX, according to the above-recited equation (5), by using the above mentioned correlation values, i.e., $$^t(AC)AX,\ ^t(AC)AP \text{ and } ^t(AC)AC.$$

Thus, the sequential optimization CELP coding method is superior to the simultaneous optimization CELP coding method, from the view point that the former method requires a lower overall computation amount than that required by the latter method. Nevertheless, the former method is inferior to the latter method, from the view point that the decoded speech quality is poor in the former method.

Figure 5A:
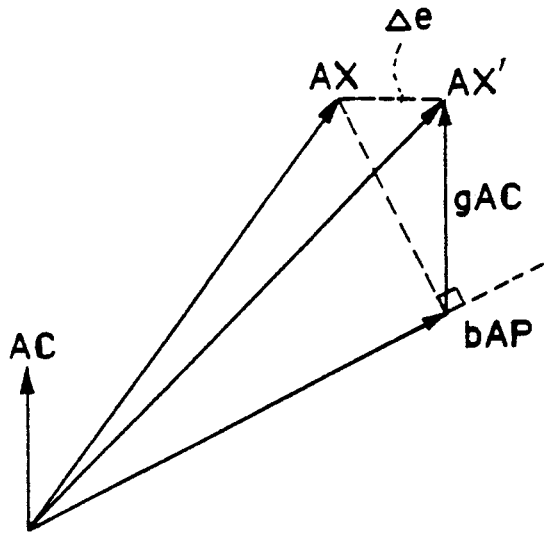
FIG. 5A is a vector diagram representing the conventional sequential optimization CELP coding.
Figure 5B:
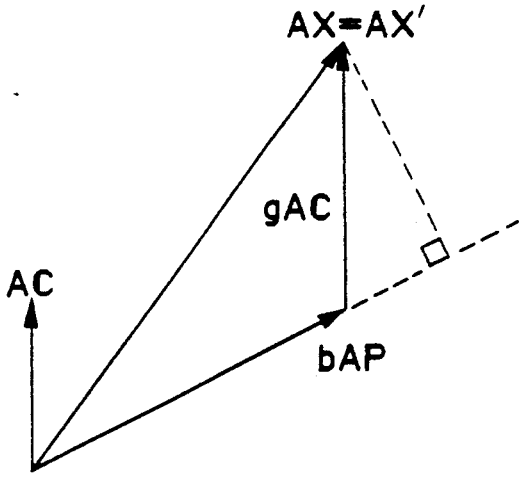
FIG. 5B is a vector diagram representing the conventional, simultaneous optimization CELP coding.
Figure 5C:
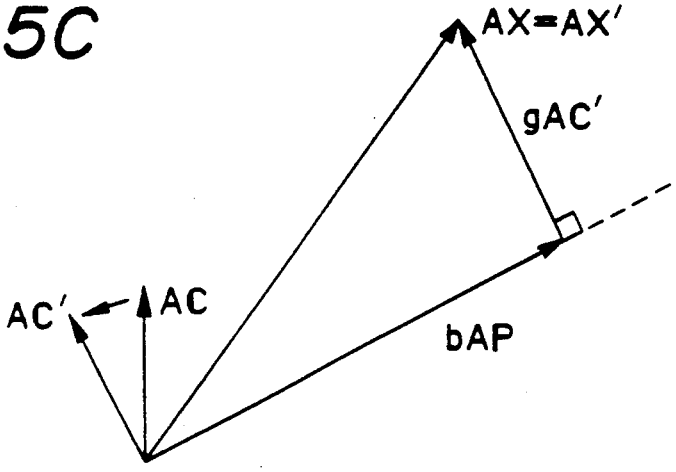
FIG. 5C is a vector diagram representing a gain optimization CELP coding most preferable for the present invention.

FIG. 5A is a vector diagram representing the conventional sequential optimization CELP coding; FIG. 5B is a vector diagram representing the conventional simultaneous optimization CELP coding; and FIG. 5C is a vector diagram representing a gain optimization CELP coding most preferable to the present invention. These figures represent vector diagrams by taking a two-dimensional vector as an example.

In the case of the sequential optimization CELP coding (FIG. 5A), a relatively small computation amount is needed to obtain the optimized vector AX', i.e., $$AX' = bAP + gAC.$$

In this case, however an undesirable error $\Delta e$ is liable to appear between the vector AX' and the input vector AX, which lowers the quality of the reproduced speech.

In the case of the simultaneous optimization CELP coding (FIG. 5B), $$AX' = AX$$

can stand as shown in FIG. 5B, and consequently, the quality of the reproduced speech becomes better than the case of FIG. 5A. In the case of FIG. 5B, however the computation amount becomes large, as can be understood from the above-recited equation (5).

It is known that the CELP coding method, in general, requires a large computation amount, and to overcome this problem, as mentioned previously, the sparse-stochastic codebook is used. Nevertheless, the current reduction of the computation amount is insufficient, and accordingly the present invention provides a special sparse-stochastic codebook.

Figure 6:
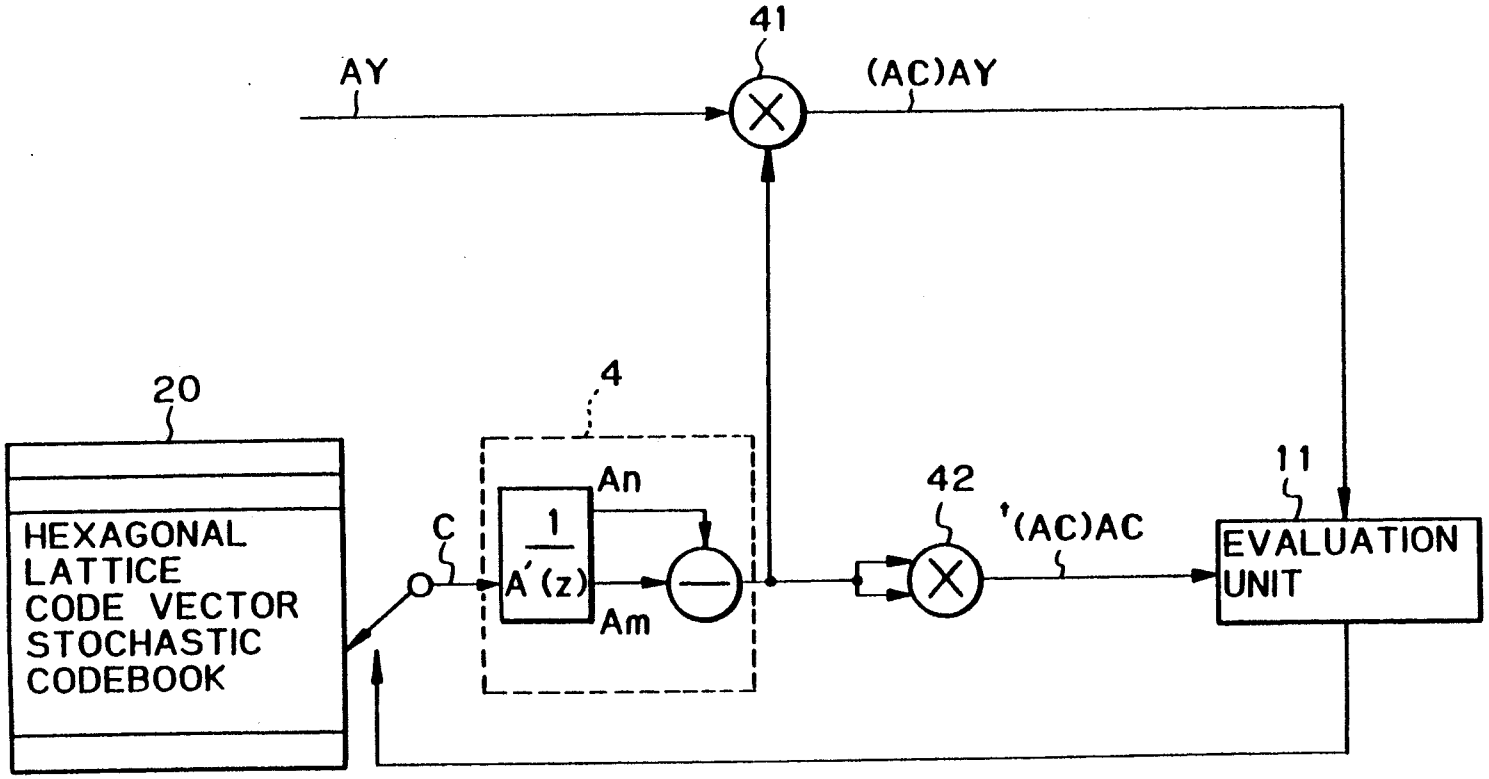
FIG. 6 is a block diagram showing a principle of the construction based on the sequential optimization coding, according to the present invention.

FIG. 6 is a block diagram showing a principle of the construction based on the sequential optimization coding according to the present invention. Namely, FIG. 6 is a conceptual depiction of an optimization algorithm for the selection of optimum code vectors from a hexagonal lattice code vector stochastic codebook 20 and the selection of the gain b, which is an improvement over the prior art algorithm shown in FIG. 3.

The present invention is featured by code vectors to be loaded in the sparse-stochastic codebook. The code vectors are formed as multi-dimensional polyhedral lattice vectors, herein referred to as the hexagonal lattice code vectors, each consisting of a zero vector with one sample set to +1 and another sample set to −1.

Figure 7:
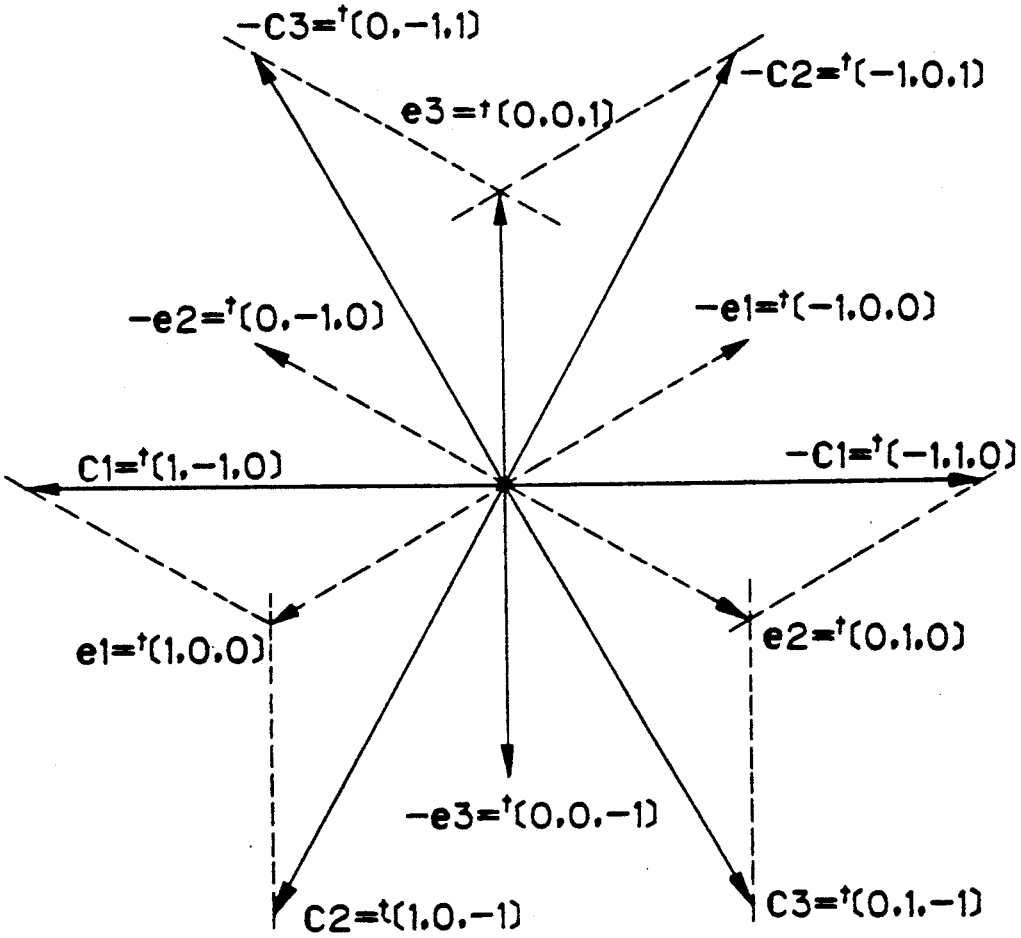
FIG. 7 is a two-dimensional vector diagram representing hexagonal lattice code vectors according to the basic concept of the present invention.

FIG. 7 is a two-dimensional vector diagram representing hexagonal lattice code vectors according to the basic concept of the present invention. The hexagonal lattice code vector stochastic codebook 20 is set up by vectors $C_1$, $C_2$, and $C_3$ depicted in FIG. 7. These three vectors are located on a two-dimensional paper which is perpendicular to a three-dimensional reference vector defined as, for example, $^t[1, 1, 1]$, where the symbol t denotes a transpose, and the three vectors are set by unit vectors $e_1$, $e_2$ and $e_3$ extending along the x-axis, y-axis and z-axis, respectively, and located on the planes defined by the x-y axes, y-z axes, and z-x axes, respectively.

Accordingly, for example, the code vector $C_1$ is formed by a composite vector of $e_1+(-e_2)$.

Here, assuming that an N-dimensional matrix as $$I=[e_1, e_2, -e_n]$$

each of the hexagonal lattice code vectors C is expressed as $$C_{n,m}=[e_n-e_m].$$

Namely, each vector C is constructed by a pair of impulses +1 and −1 and the remaining samples, which are zero vectors.

Therefore, the vector AC, which is obtained by multiplying the hexagonal lattice code vector C with the perceptual weighting matrix A, i.e., $$A=[A_1, A_2, -A_N]$$

at the filter 4, is expressed as follows.

$$AC=Aen-Ae_m=A_n-A_m$$

As understood from the above equation, the vector AC can be generated merely by picking up both the element n and the element m of the matrix and then subtracting one from the other, and if the thus-generated vector AC is used for performing a correlation operation at multiplying units 41 and 42, the computation amount can be greatly reduced.

In this case, it is known that such a very sparse codebook does not affect the reproduced speech quality.

Figure 8:
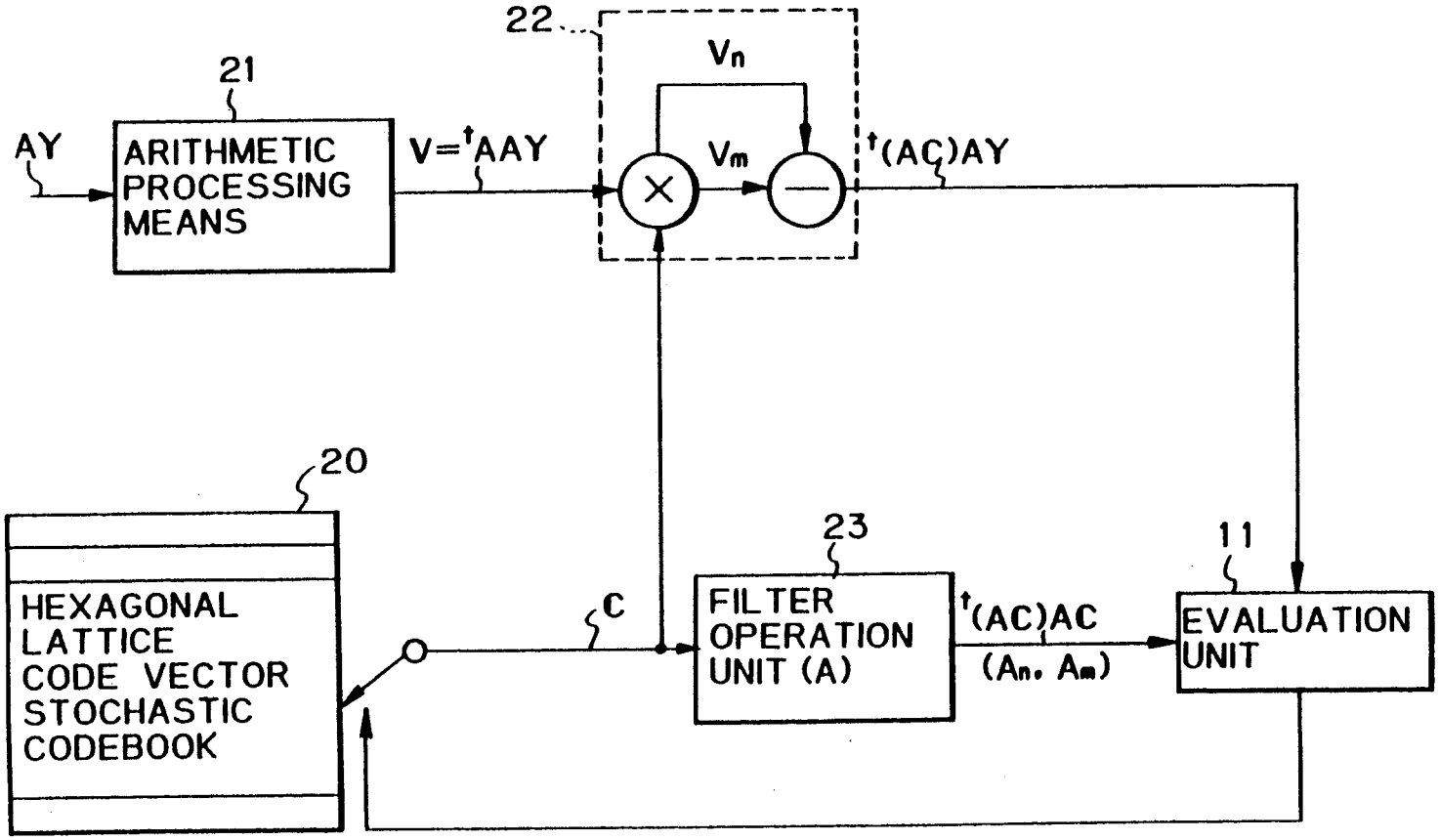
FIG. 8 is a block diagram showing another principle of the construction based on the sequential optimization coding, according to the present invention.

FIG. 8 is a block diagram showing another principle of the construction based on the sequential optimization coding according to the present invention. In this case, the autocorrelation value $^t$(AC)AC to be input to the evaluation unit 11 is calculated, as in FIG. 6, by a combination of both of the filters 4 and 42, and the correlation value $^t$(AC)AY to be input, to the evaluation unit 11 is generated by first transforming the pitch prediction error signal vector AY, at an arithmetic processing means 21, into $^t$AAY, and then applying the code vector C from the hexagonal lattice stochastic codebook 20, as is, to a multiplying unit 22. This enables the related operation to be carried out by making good use of the advantage of the hexagonal lattice codebook 20 as is, and thus the computation amount becomes smaller than in the case of FIG. 6.

Figure 9:
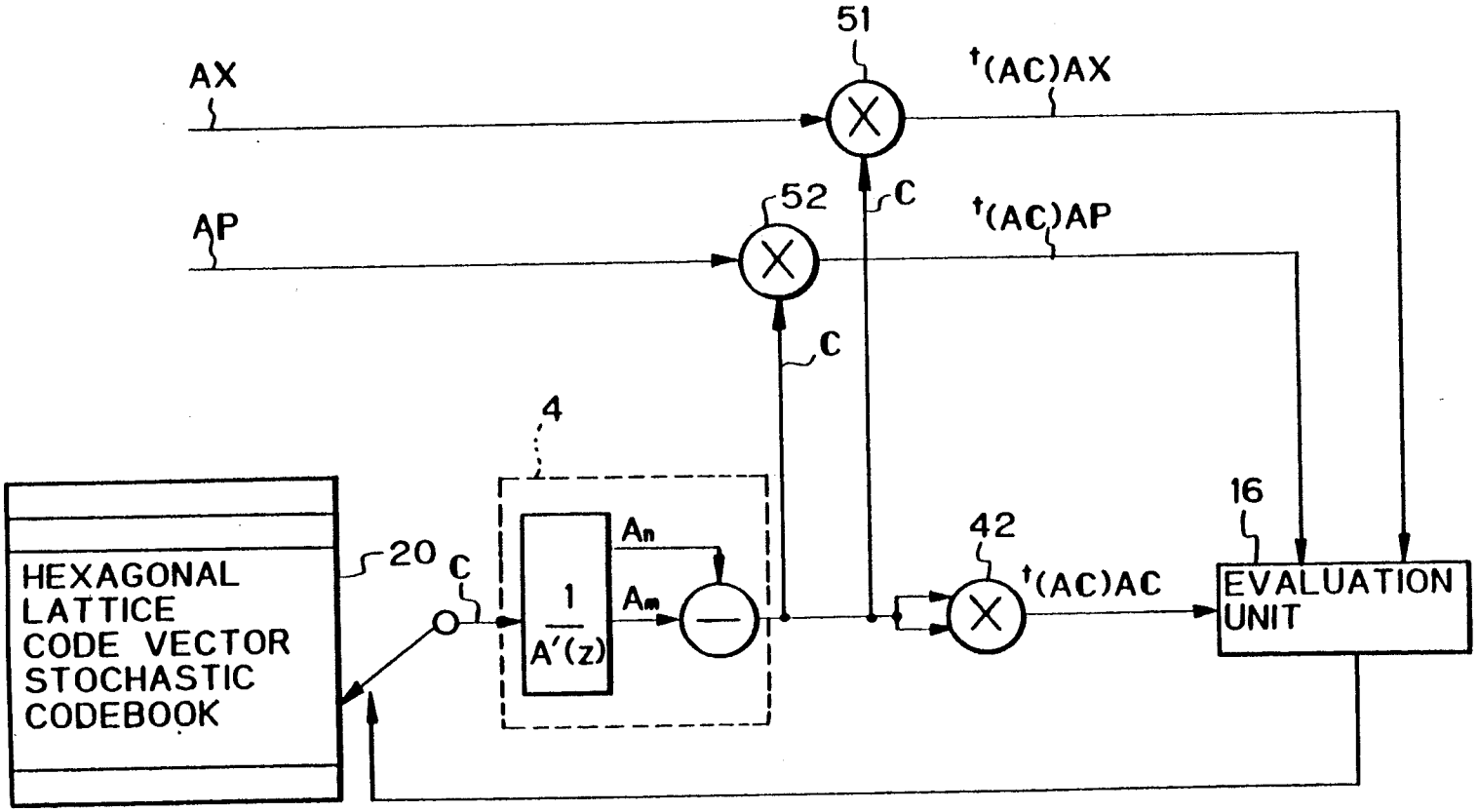
FIG. 9 is a block diagram showing a principle of the construction based on the simultaneous optimization coding, according to the present invention.

Similarly, the prior art simultaneous optimization CELP coding of FIG. 4 can be improved by the present invention as shown in FIG. 9.

FIG. 9 is a block diagram showing a principle of the construction based on the simultaneous optimization coding according to the present invention. The computation amount needed in the case of FIG. 9 can be made smaller than that needed in the case of FIG. 4.

Figure 10:
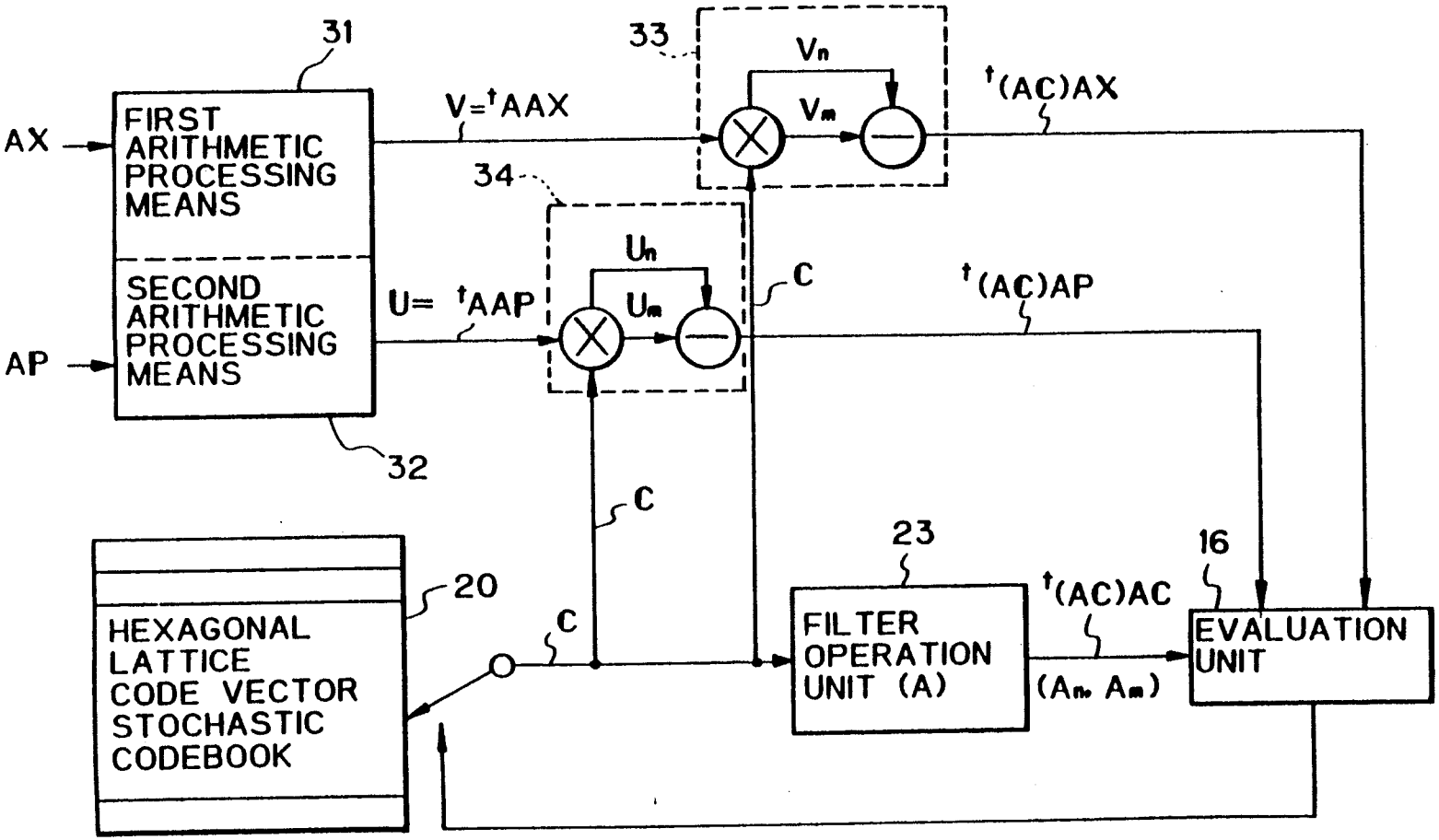
FIG. 10 is a block diagram showing another principle of the construction based on the simultaneous optimization coding, according to the present invention.

The concept of FIG. 8 can be also adopted to the simultaneous optimization CELP coding as shown in FIG. 10.

FIG. 10 is a block diagram showing another principle of the construction based on the simultaneous optimization coding according to the present invention. By adopting the concept of FIG. 8, the input speech signal vector AX is transformed to $^t$AAX at a first arithmetic processing means 31; the pitch prediction vector AP is transformed to $^t$AAP at a second arithmetic processing means 34; and the thus-transformed vectors are multiplied by the hexagonal lattice code vector C, respectively. Accordingly, the computation amount is limited to only the number of hexagonal lattice vectors.

The present invention can be applied to not only the above-mentioned sequential and simultaneous optimization CELP codings, but also to a gain optimization CELP coding as shown in FIG. 7C, but the best results by the present invention are produced when it is applied to the optimization CELP coding shown in FIG. 5C. This will be explained below in detail.

Figure 11:
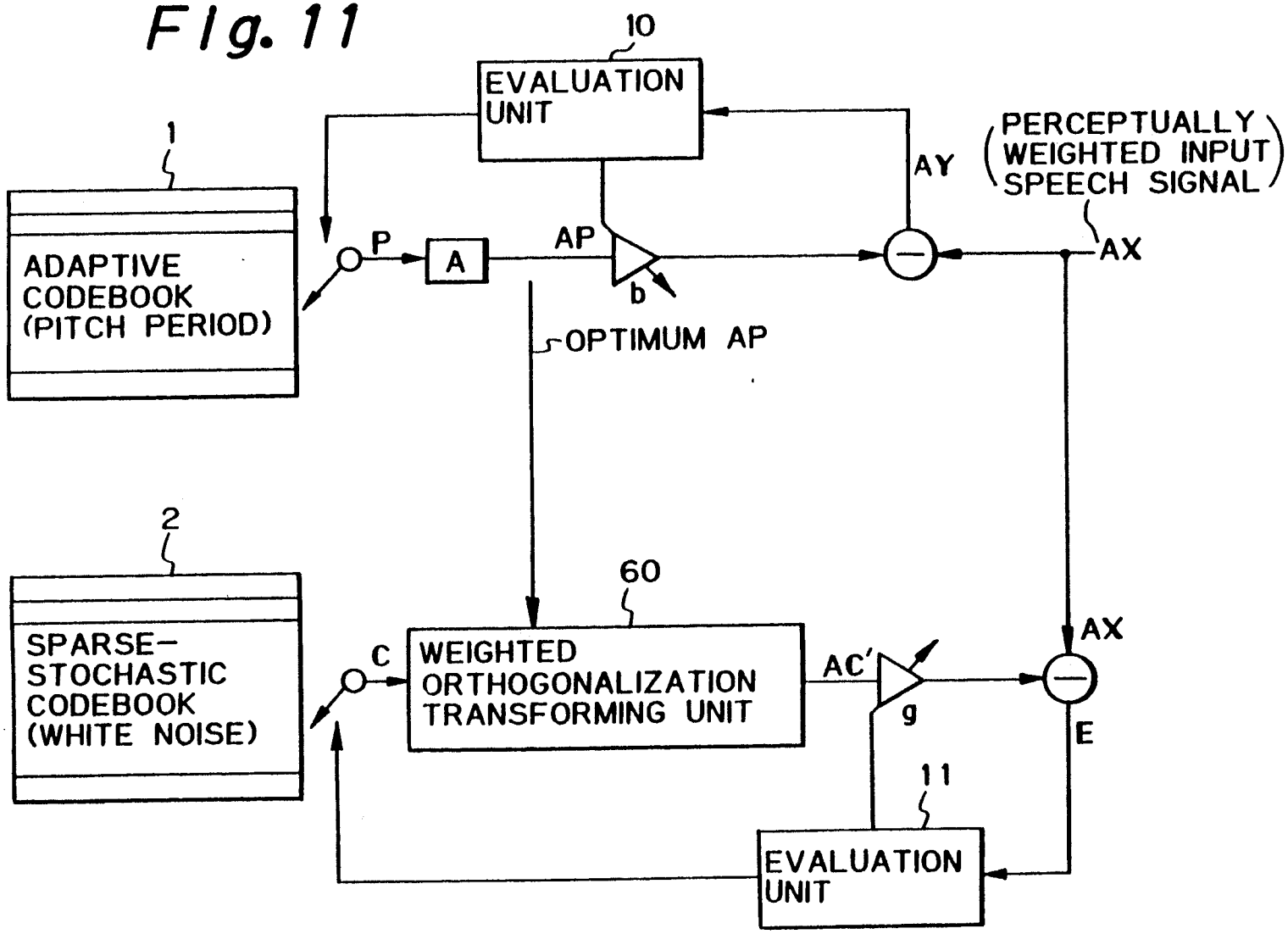
FIG. 11 is a block diagram showing a principle of the construction based on an orthogonalization transform CELP coding to which the present invention is preferably applied.

FIG. 11 is a block diagram showing a principle of the construction based on an orthogonalization transform CELP coding to which the present invention is most preferably applied.

Regarding the pitch period, an evaluation and a selection of the pitch prediction residual vector P and the gain b are performed in the usual way but, for the code vector C, a weighted orthogonalization transforming unit 60 is mounted in the system. The unit 60 receives each code vector C, from the conventional sparse-stochastic codebook 2, and the received code vector C is transformed into a perceptually reproduced code vector AC′ which is orthogonal to the optimum pitch prediction vector AP among each of the perceptually weighted pitch prediction residual vectors. Namely, the orthogonal vector AC′, not the usual vector AC, is used for the evaluation by the evaluation unit 11.

This will be further clarified with reference to FIG. 5C. Note that, under the sequential optimization coding method (FIG. 5A), a quantization error is made larger as depicted by Δe in FIG. 5A, since the code vector AC, which has been taken as the vector C from the codebook 2 and perceptually weighted by A, is not orthogonal relative to the perceptually weighted pitch prediction reproduced signal vector bAP. Based on the above, if the code vector AC is transformed to the code vector AC′ which is orthogonal to the pitch prediction vector AP, by a known transformation method, the quantization error can be minimized, even under the sequential optimization CELP coding method of FIG. 5A, to a quantization error comparable to that obtained by the simultaneous optimization method (FIG. 5B).

The gain g is multiplied with the thus-obtained code vector AC′, to generate the linear prediction reproduced signal vector gAC′. The evaluation unit 11 selects the code vector from the codebook 2 and selects the gain g, which can minimize the power of the linear prediction error signal vector E, by using the thus generated gAC′ and the perceptually weighted input speech signal vector AX.

Here, the present invention is actually applied to the orthogonalization transform CELP coding system of FIG. 11 based on the algorithm of FIG. 5C.

Figure 12:
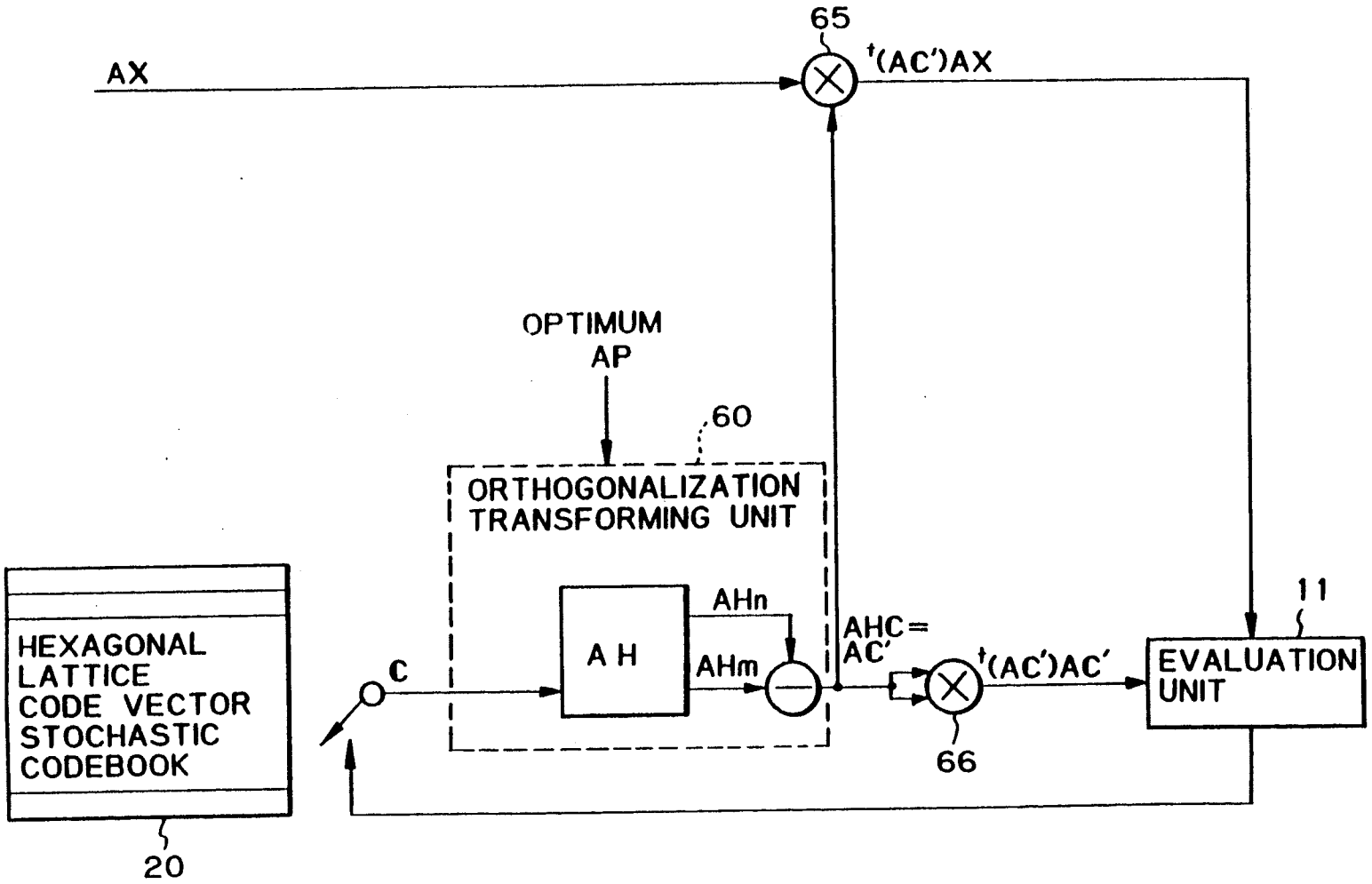
FIG. 12 is a block diagram showing a principle of the construction based on the orthogonalization transfer CELP coding to which the present invention is applied.

FIG. 12 is a block diagram showing a principle of the construction based on the orthogonalization transfer CELP coding to which the present invention is applied. Namely, the conventional sparse-stochastic codebook 2 is replaced by the hexagonal lattice code vector stochastic codebook 20. The orthogonalization transforming unit 60 generates the perceptually weighted reproduced code vector AC′ which is orthogonal to the optimum pitch prediction vector AP among the code vectors C from the hexagonal lattice stochastic codebook 2 which are perceptually weighted by A. In this case, the transforming matrix H for applying the orthogonalization to C' relative to AP is indicated as $$C'=HC.$$

Thus, the final vector AC' can be calculated by very simple equation, as follows.

$$AC'-AHC=HA_n-HA_m$$

This means that the computation amount needed for the correlation operation $^t$(AC)AX at a multiplying unit 65, and for the autocorrelation operation t(AC')AC' at a multiplying unit 66 can be greatly reduced.

Figure 13:
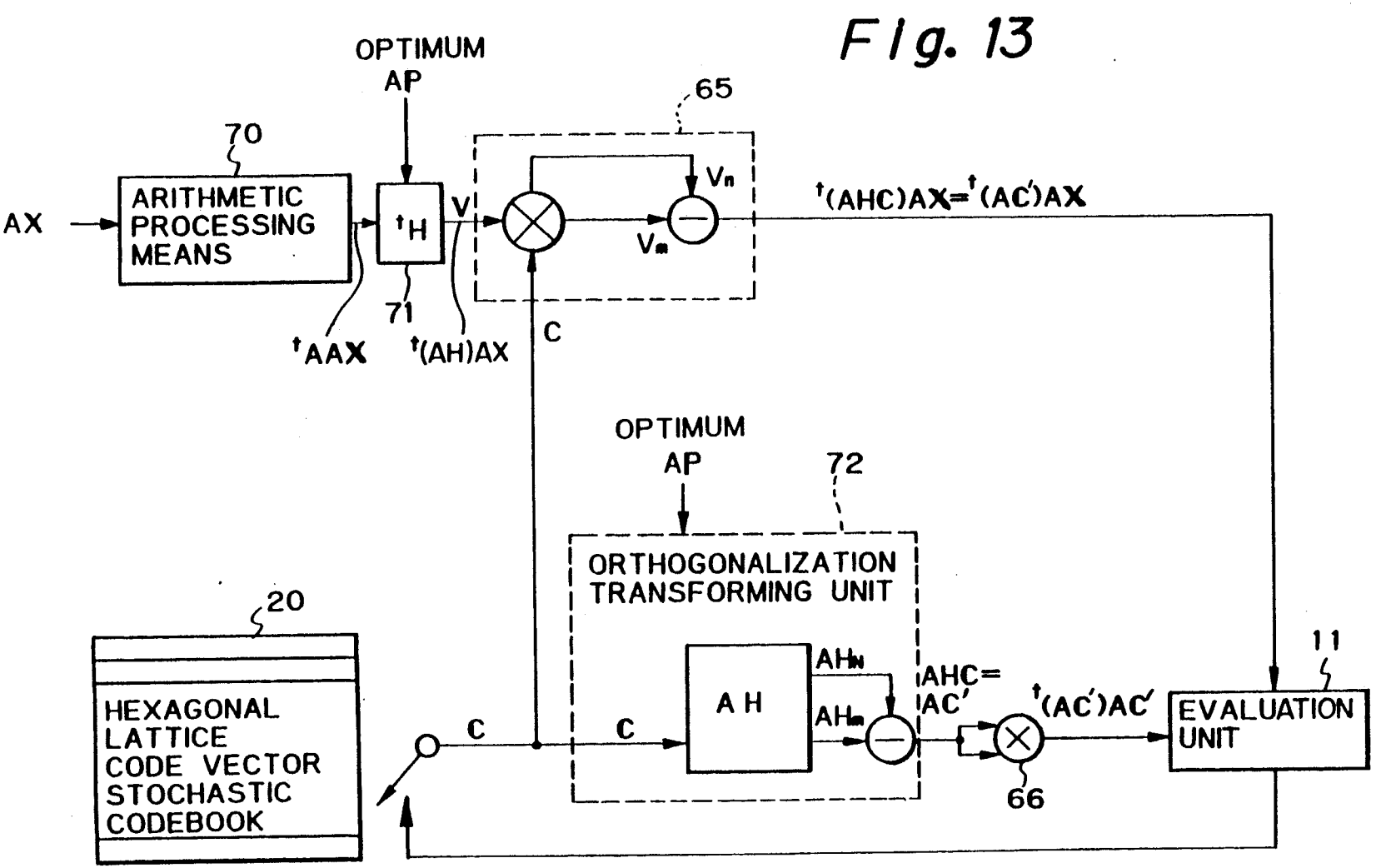
FIG. 13 is a block diagram showing a principle of the construction based on another orthogonalization transform CELP coding to which the present invention is applied.

FIG. 13 is a block diagram showing a principle of the construction based on another orthogonalization transform CELP coding to which the present invention is applied. The construction of FIG. 13 is created by taking into account the fact that, in FIG. 12, the operation at the multiplying unit 65 is carried out between the two vectors, i.e., AC' ($=AHC=HA_n-HA_m$) and AX. For a further reduction in the computation amount, as in the case of FIG. 8 or FIG. 10, the perceptually weighted input speech signal vector AX is applied to an arithmetic processing means 70, to generate a time-reversed perceptually weighted input speech signal vector $^t$AAX. The vector $^t$AAX is then applied to a time-reversed orthogonalization transforming unit 71 to generate a time-reversed perceptually weighted orthogonally transformed input speech signal vector $^t$(AH)AX with respect to the optimum perceptually weighted pitch prediction residual vector AP.

Then, both the thus generated time-reversed perceptually weighted orthogonally transformed input speech signal vector $^t$(AH)AX and each code vector C of the hexagonal lattice stochastic codebook 20 are multiplied at the multiplying unit 65, to generate the correlation value $^t$(AHC)AX therebetween.

Further, the orthogonalization transforming unit 72 calculates, as in the case of FIG. 12, the perceptually weighted orthogonally transformed code vector AHC relative to the optimum perceptually weighted pitch prediction residual vector AP, which AHC is then sent to the multiplying unit 66 to find the related autocorrelation $^t$(AHC)AHC.

Thus, the vector $^t$(AH)AX, obtained by applying the time-reversed perceptual weighting at the arithmetic processing unit 70 to a time-reversed orthogonalization transforming matrix H at the transforming unit 71, is then used to find the correlation value therebetween, i.e., $$^t(AHC)AX={}^t(AC')AX$$

is obtained only by multiplying the code vector C of the hexagonal lattice codebook 20 as is, at the multiplying unit 65, whereby the computation amount can be reduced.

Figure 14:
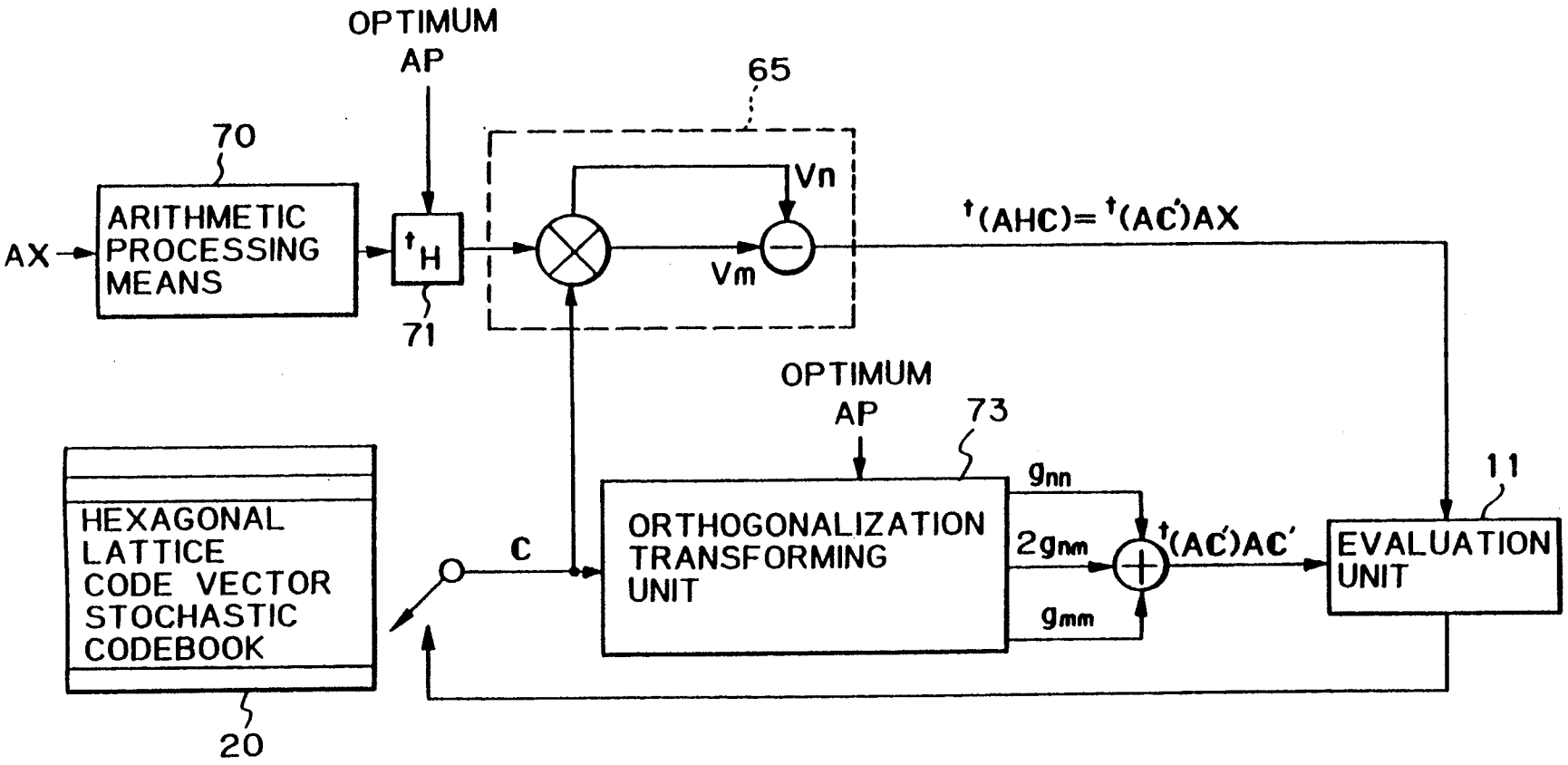
FIG. 14 is a block diagram showing a principle of the construction which is an improved version of the construction of FIG. 13.

FIG. 14 is a block diagram showing a principle of the construction which is an improved version of the construction of FIG. 13. In the figure, the multiplying operation at the multiplying unit 65 is identical to that of FIG. 13, except that an orthogonalization transforming unit 73 is employed in the latter system: At the stage preceding the unit 73, an autocorrelation matrix $^t$(AH)AH, which is renewed at every frame, of the time-reversed transforming matrix $^t$(AH) is produced by the arithmetic processing means 70 and the time-reversed orthogonalization transforming unit 71. Then, from the matrix $^t$(AH)AH, three elements (n, n), (n, m) and (m, m) are taken out, which elements define each code vector C of the hexagonal lattice codebook 20. The elements are used to calculate an autocorrelation value $^t$(AC')AC' of the code vector AC', which is perceptually weighted and orthogonally transformed relative to the optimum perceptually weighted pitch prediction residual vector AP.

Namely, the autocorrelation to be found by the orthogonalization transforming unit 73 is equal to an autocorrelation matrix $^t$(AH)AH supplemented with the code vector C, which results in $^t$(AHC)AHC. Since $$AC=A_n-A_m$$

stands as explained before, the vector is rewritten as follows.

$$\begin{aligned} {}^t(AHC)AHC &= {}^tH^t(A_n - A_m)H(A_n - A_m) \\ &= {}^tH^tA_nA_nH - {}^tH^tA_mA_nH - \\ &\quad {}^tH^tA_nA_mH + {}^tH^tA_mA_mH \\ &= ({}^tH^tAAH)_{n,n} - 2({}^tH^tAAH)_{n,m} + \\ &\quad ({}^tH^tAAH)_{m,m} \end{aligned}$$

Assuming that the matrix $^tH^tAAH$ in the above equation is prepared in advance, and is renewed at every frame, the autocorrelation value $^t$(AC')AC' of the code vector AC' can be obtained only by taking out the three elements (n, n), (n, m) and (m, m) from the above matrix, which code vector AC' is a perceptually weighted and orthogonally transformed code vector relative to the optimum perceptually weighted pitch prediction residual vector AP.

As explained above, the present invention is applicable to any type of CELP coding, such as the sequential optimization, the simultaneous optimization and orthogonally transforming CELP codings, and the computation amount can be greatly reduced due to the use of the hexagonal lattice codebook 20.

Figure 15A:
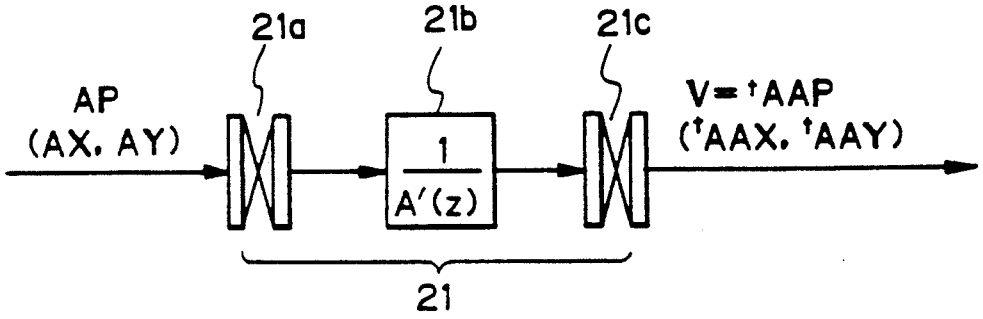
FIGS. 15A and 15B illustrate first and second examples of the arithmetic processing means shown in FIGS. 8, 10, 13 and 14.
Figure 15B:
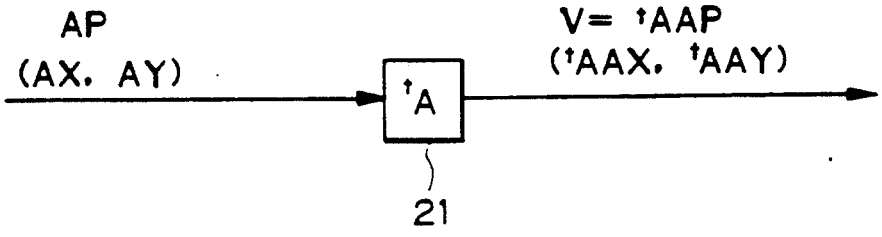

FIGS. 15A and 15B illustrate first and second examples of the arithmetic processing means shown in FIGS. 8, 10, 13 and 14. In FIG. 15A, the arithmetic processing means is comprised of members 21*a*, 21*b* and 21*c*. The member 21*a* is a time-reversed unit which rearranges the input signal (optimum AP) inversely along a time axis. The member 21*b* is an infinite impulse response (IIR) perceptual weighting filter comprised of a matrix A ($=1/A'(Z)$). The member 21*c* is another time-reversed unit which arranges again the output signal from the filter 21*b* inversely along a time axis, and thus the arithmetic sub-vector V ($={}^t$AAP or $^t$AAX, $^t$AAY) is generated thereby.

FIGS. 16A to 16D depict an embodiment of the arithmetic processing means shown in FIG. 15A in more detail and from a mathematical viewpoint. Assuming that the perceptually weighted pitch prediction residual vector AP is expressed as shown in FIG. 16A, a vector $(AP)_{TR}$ becomes as shown in FIG. 16B which is obtained by rearranging the elements of FIG. 16A inversely along a time axis.

The vector $(AP)_{TR}$ of FIG. 16B is applied to the IIR perceptual weighting linear prediction reproducing filter (A) 21*b*, having a perceptual weighting filter function $1/A'(Z)$, to generate the $A(AP)_{TR}$ as shown in FIG. 16C.

In this case, the matrix A corresponds to a reversed matrix of a transpose matrix, $^tA$, and therefore, the $A(AP)_{TR}$ can be returned to its original form by rearranging the elements inversely along a time axis, and thus the vector of FIG. 16D is obtained.

The arithmetic processing means may be constructed by using a finite impulse response (FIR) perceptual weighting filter which multiplies the input vector AP with a transpose matrix, i.e., $^tA$. An example thereof is shown in FIG. 15B.

FIGS. 17A to 17C depict an embodiment of the arithmetic processing means shown in FIG. 15B in more detail and from a mathematical viewpoint. In the figures, assuming that the FIR perceptual weighting filter matrix is set as A and the transpose matrix $^tA$ of the matrix A is an N-dimensional matrix, as shown in FIG. 7A, corresponding to the number of dimensions N of the codebook, and if the perceptually weighted pitch prediction residual vector AP is formed as shown in FIG. 17B (this corresponds to a time-reversed vector of FIG. 16B), the time-reversed perceptual weighting pitch prediction residual vector $^tAAP$ becomes a vector as shown in FIG. 17C, which vector is obtained by multiplying the above-mentioned vector AP with the transpose matrix $^tA$. Note, in FIG. 16C, the symbol * denotes a multiplication symbol, and in this case, the accumulated multiplication number becomes $N^2/s$, and thus the result of FIG. 16D and the result of FIG. 17C become the same.

Although, in FIGS. 16A to 16D, the filter matrix A is formed as the IIR filter, it is also possible to use the FIR filter therefor. If the FIR filter is used, however the overall number of calculations becomes $N^2/2$ (plus 2N times shift operations) as in the embodiment of FIGS. 17A to 17C. Conversely, if the IIR filter is used, and assuming that a tenth order linear prediction analysis is achieved as an example, just 10N calculations plus 2N shift operations need be used for the related arithmetic processing.

Figure 18:
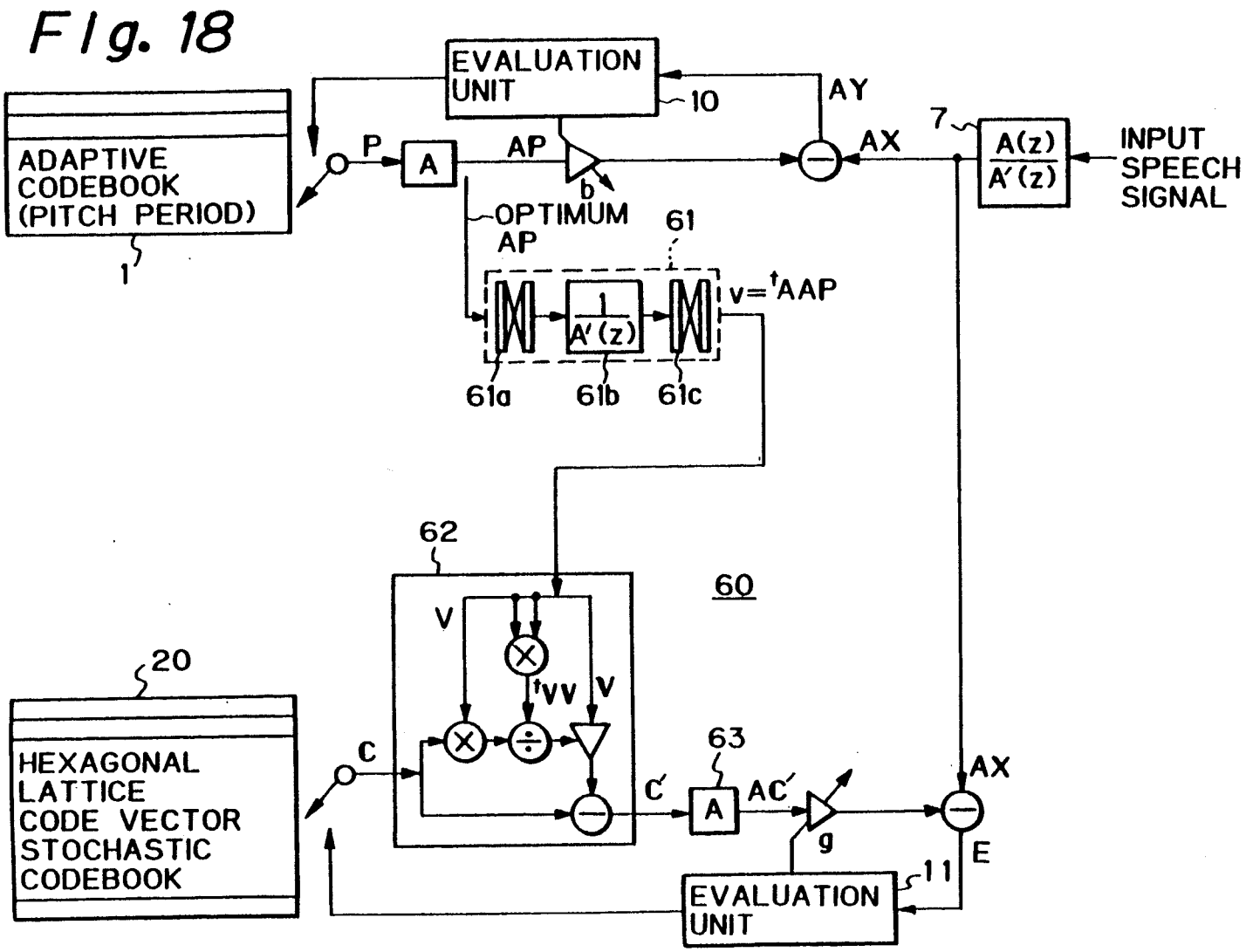
FIG. 18 is a block diagram showing a first embodiment based on the structure of FIG. 11 to which the hexagonal lattice codebook is applied.

FIG. 18 is a block diagram showing a first embodiment based on the structure of FIG. 11 to which the hexagonal lattice codebook 20 is applied. The construction is basically the same as that of FIG. 11, except that the conventional sparse-codebook 2 is replaced by the hexagonal lattice vector codebook 20 of the present invention.

In the first embodiment, an orthogonalization transforming unit 60 is comprised of: an arithmetic processing means 61 similar to the aforesaid arithmetic processing means 61 of FIG. 15A which receives the optimum perceptually weighted pitch prediction residual vector AP and generates an arithmetic sub-vector V (=$^tAAP$); a Gram-Schmidt orthogonalization transforming unit 62 which generates a vector C' from the code vector C of the hexagonal lattice codebook 20 such that the vector C' becomes orthogonal to the vector V; and a filter matrix A, which applies the perceptual weighting to the code vector C' to generate the vector AC'.

In the above case, the Gram-Schmidt orthogonalization arithmetic equation is given by $$C'=C-V(^tVC/^tVV) \quad (6)$$

The transformer 62 of FIG. 18 is applied to realize the above algorithm. Note, in the figure, each circle mark represents a vector operation and each triangle mark represents a scalar operation.

Figure 19A:
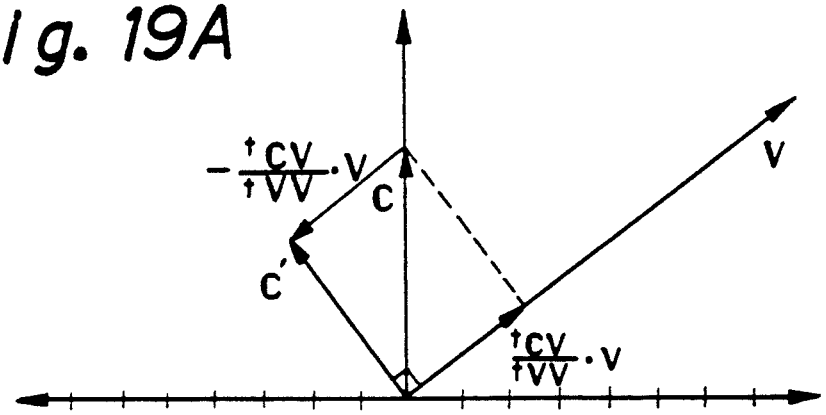
FIG. 19A is a vector diagram representing a Gram-Shmidt orthogonalization transform.
Figure 19B:
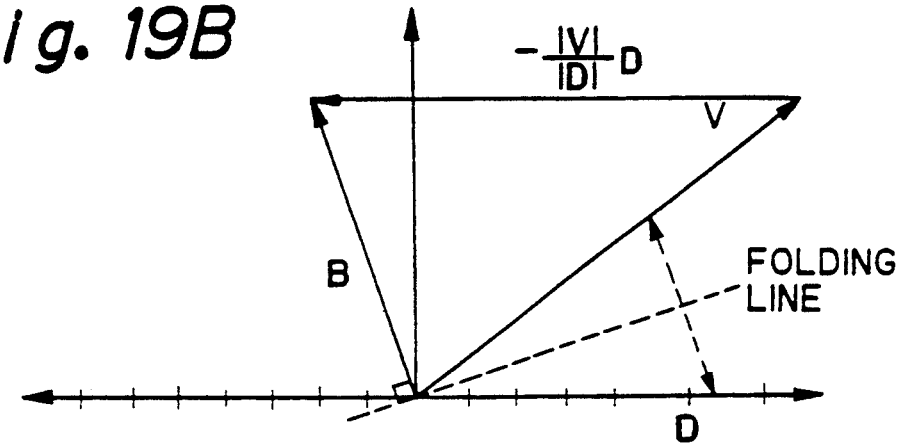
FIG. 19B is a vector diagram representing a householder transform for determining an intermediate vector B.
Figure 19C:
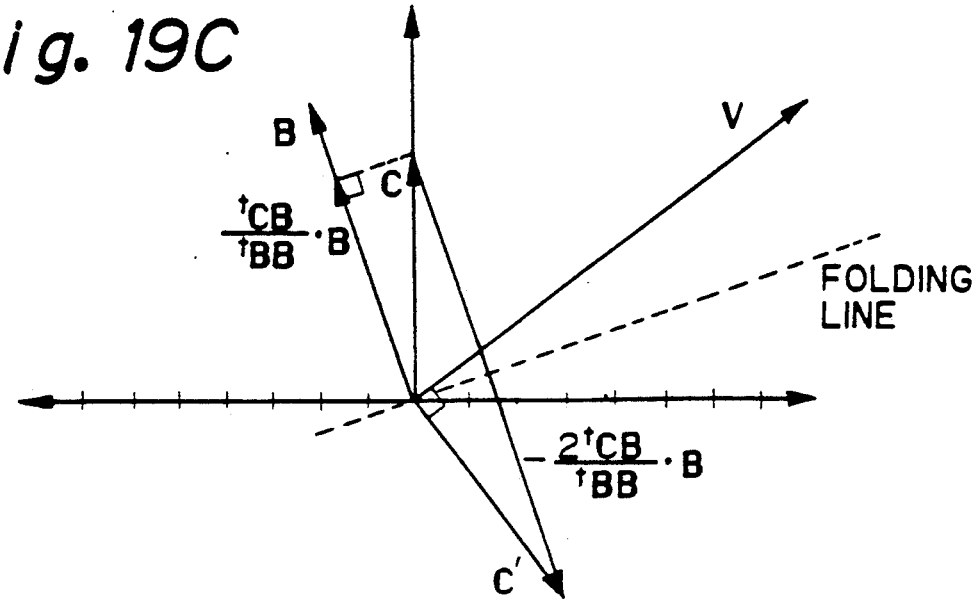
FIG. 19C is a vector diagram representing a householder transform for determining a final vector C'.

FIG. 19A is a vector diagram for representing a Gram-Schmidt orthogonalization transform; FIG. 19B is a vector diagram representing a householder transform for determining an intermediate vector B; and FIG. 19C is a vector diagram representing a householder transform for determining a final vector C'.

Referring to FIG. 19A, a parallel component of the code vector C relative to the vector V is obtained by multiplying the unit vector ($V/^tVV$) of the vector V with the inner product $^tCV$ therebetween, and the result becomes $$^tCV(V/^tVV).$$

Consequently, the vector C' orthogonal to the vector V can be given by the above-recited equation (6).

The thus-obtained vector C' is applied to the perceptual weighting filter 63 to produce the vector AC'. The optimum code vector C and gain g can be selected by applying the above vector AC' to the sequential optimization CELP coding shown in FIG. 3.

Figure 20:
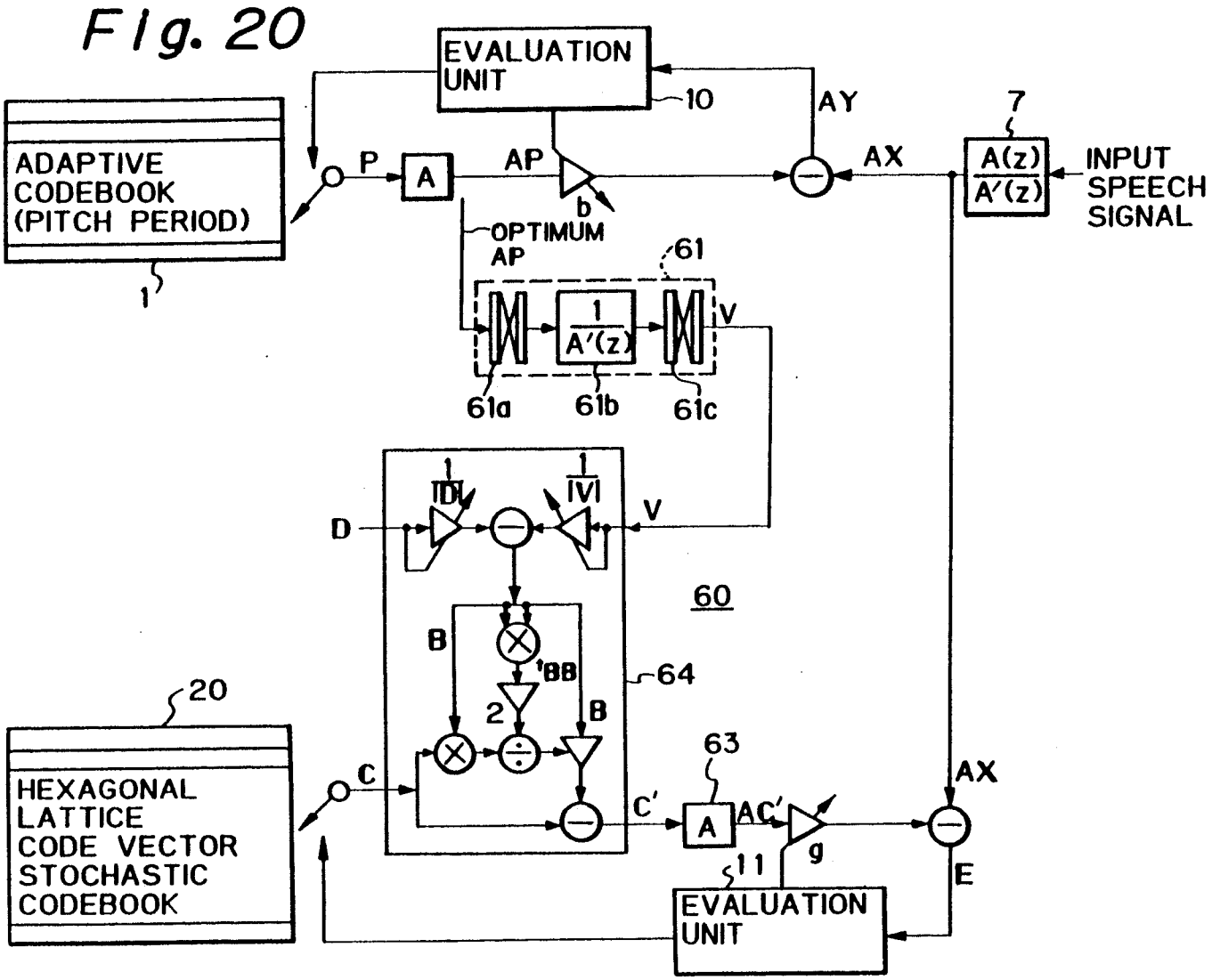
FIG. 20 is a block diagram showing a second embodiment based on the structure of FIG. 11 to which the hexagonal lattice codebook is applied.

FIG. 20 is a block diagram showing a second embodiment, based on the structure of FIG. 11, to which the hexagonal lattice codebook is applied. The construction (based on FIG. 12) is basically the same as that of FIG. 18, except that an orthogonalization transformer 64 is employed instead of the orthogonalization transformer 62.

The transforming equation performed by the transformer 64 is indicated as follows.

$$C'=C-2B\{(^tBC)/(^tBB)\} \quad (8)$$

The above equation is applied to realize the householder transform. In the equation (8), the vector B is expressed as follows.

$$B=V-|V|D$$

where the vector D is orthogonal to all the code vectors C of the hexagonal lattice code vector stochastic codebook 20.

Referring back to FIGS. 19B and 19C, the algorithm of the householder transform will be explained. First, the arithmetic sub-vector V is folded, with respect to a folding line, to become the parallel component of the vector D, and thus a vector $(|V|/|D|)D$ is obtained. Here, $D/|D|$ represents a unit vector of the direction D.

The thus-created D direction vector is used to create another vector in a direction reverse to the D direction, i.e., −D direction, which vector is expressed as $$-(|V|/|D|)D$$

as shown in FIG. 19B. This vector is then added to the vector V to obtain a vector B, i.e., $$B=V-(|V|/|D|)D$$

which becomes orthogonal to the folding line (refer to FIG. 19B).

Further, a component of the vector C projected onto the vector B is found as follows, as shown in FIG. 19A.

$$\{(^tCB)/(^tBB)\}B$$

The thus found vector is doubled in an opposite direction, i.e., $$-\frac{2^tCB}{^tBB}B,$$

and added to the vector C, and as a result the vector C' is obtained which is orthogonal to the vector V.

Thus, the vector C' is created and is applied with the perceptual weighting A to obtain the code vector AC' which is orthogonal to the optimum vector AP.

Figure 21:
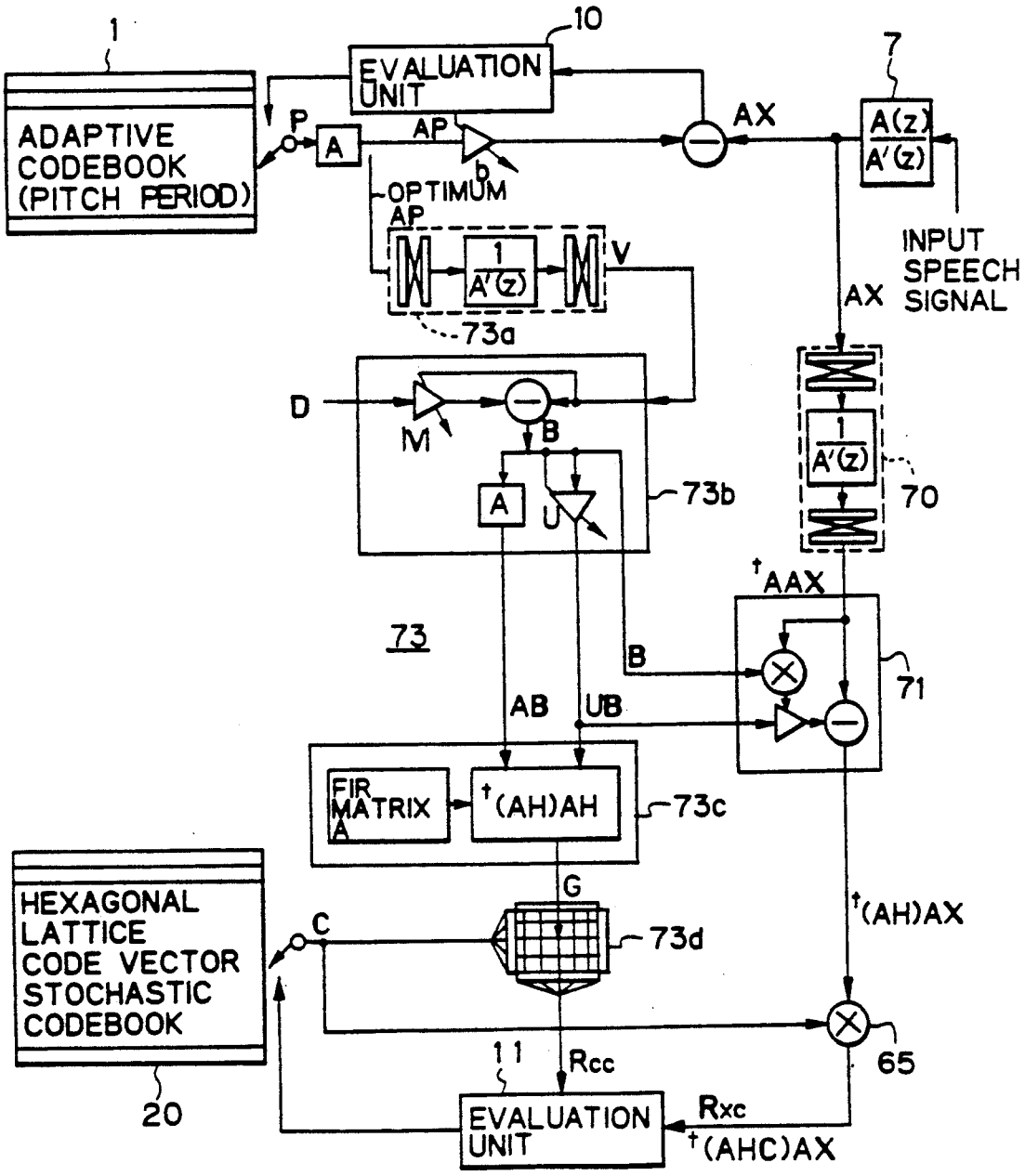
FIG. 21 is a block diagram showing an embodiment based on the principle of the construction shown in FIG. 14 according to the present invention.

FIG. 21 is a block diagram showing an embodiment based on the principle construction shown in FIG. 14 according to the present invention. In FIG. 21, the arithmetic processing means 70 of FIG. 14 can be comprised of the transpose matrix $^tA$, as in the aforesaid arithmetic processing means 21 (FIG. 15B), but in the embodiment of FIG. 21, the arithmetic processing means 70 is comprised of a time-reversing type filter which achieves an inverse operation in time.

Further, an orthogonalization transforming unit 73 is comprised of arithmetic processors 73*a*, 73*b*, 73*c* and 73*d*. The arithmetic processor 73*a* generates, similar to the arithmetic processing means 70, the arithmetic subvector V ($=^tAAP$) by applying a time-reversing perceptual weighting to the optimum pitch prediction vector AP given as an input signal thereto.

The above vector V is transformed, at the arithmetic processor 73*b* including the perceptual weighting matrix A, into three vectors B, uB and AB by using the vector D, as an input, which is orthogonal to all of the code vectors of the hexagonal lattice sparse-stochastic codebook 20.

The vectors B and uB of the above three vectors are sent to a time-reversing orthogonalization transforming unit 71, and the unit 71 applies a time-reversing householder transform to the vector $^tAAX$ from the arithmetic processing means 70, to generate $^tH^tAAX$ ($=^t$(AH-)AX).

The time-reversed householder orthogonalization transform, $^tH$, at the unit 71 will be explained below.

First, the above-recited equation (8) is rewritten, using $u=2/^tBB$, as follows.

$$C'=C-B(u^tBC) \tag{9}$$

The equation (9) is then transformed, by using $C'=HC$, as follows.

$$\begin{aligned} H &= C'C^{-1} \\ &= I - B(u^tB) \quad (I \text{ is a unit vector}) \end{aligned}$$

Accordingly, $$\begin{aligned} ^tH &= I - (uB)^tB \\ &= I - B(u^tB) \end{aligned}$$

is obtained, which is same as H written above.

Here, the aforesaid vector $^t$(AH)AX input to the transforming unit 71 is replaced by, e.g., W, and the following equation stands.

$$^tHW = W-(WB)(u^tB)$$

This is realized by the arithmetic construction as shown in the figure.

The above vector $^t$(AH)AX is multiplied, at the multiplier 65, by the hexagonal lattice code vector C from the codebook 20, to obtain a correlation value $R_{XC}$ which is expressed as shown below.

$$\begin{aligned} R_{XC} &= {^tC}^t(AH)AX \\ &= {^t(AHC)}AX \end{aligned} \tag{10}$$

The value $R_{XC}$ is sent to the evaluation unit 11.

The arithmetic processor 73*c* receives the input vectors AB and uB and finds the orthogonalization transform matrix H and the time-reversing orthogonalization transform matrix $^tH$, and further, a FIR and thus perceptual weighting filter matrix A is applied thereto, and thus the autocorrelation matrix $^t$(AH)AH of the time-reversing perceptual weighting orthogonalization transforming matrix AH produced by the arithmetic processing unit 70 and the transforming unit 71, is generated at every frame.

The thus-generated autocorrelation matrix $^t$(AH)AH, G, is stored in the arithmetic processor 73*d* to produce, when the hexagonal lattice code vector C of the codebook 20 is sent thereto, the vector $^t$(AHC)AHC, which is written as follows, as previously shown.

$$\begin{aligned} {^t(AHC)}AHC &= {^tH^t}(A_n - A_m)H(A_n - A_m) \\ &= {^tH^tA_nA_nH} - {^tH^tA_mA_nH} - \\ &\quad {^tH^tA_nA_mH} + {^tH^tA_mA_mH} \\ &= ({^tH^tAAH})_{n,n} - 2({^tH^tAAH})_{n,m} + \\ &\quad ({^tH^tAAH})_{m,m} \end{aligned}$$

Accordingly by only taking out three elements (n, n), (n, m) and (m, m) in the matrix, i.e., $^tH^tAAH={^t}$(AH-)AH, from the arithmetic processor 73*d* and sending same to the evaluation unit 11, the autocorrelation value $R_{CC}$, expressed as below in the equation (11), of the code vector AC' can be produced, which vector AC'0 is obtained by applying the perceptual weighting and the orthogonalization transform to the optimum perceptually weighted pitch prediction residual vector AP.

$$\begin{aligned} R_{CC} &= {^t(AHC)}AHC \\ &= {^t(AC')}AC' \end{aligned} \tag{11}$$

The thus-obtained value $R_{CC}$ is sent to the evaluation unit 11.

Thus the evaluation unit 11 receives two correlation values, and by using same, selects the optimum code vector and the gain.

The following table clarifies the multiplication number needed in a variety of CELP coding systems.

TABLE

| CODEBOOK | SYSTEM | MULTIPLICATION NUMBER FILTERING PLUS TRANSFORMING | CORRELATION | AUTO CORRELATION | TOTAL N = 60 |
|---|---|---|---|---|---|
| ‡ SPARSE TYPE (CONVENTIONAL) | SEQUENTIAL OPTIMIZATION (FIG. 3) | $N^2/8$ | N/4 | N | 525 |
| | SIMULTANEOUS OPTIMIZATION (FIG. 4) | $N^2/8$ | N/2 | N | 540 |

TABLE-continued

| CODEBOOK | SYSTEM | MULTIPLICATION NUMBER FILTERING PLUS TRANSFORMING | CORRELATION | AUTO CORRELATION | TOTAL N = 60 |
|---|---|---|---|---|---|
| | ORTHOGONALIZATION TRANSFORM (FIG. 11) | $N^2/8 + 5N/4$ | N/4 | N | 600 |
| HEXAGONAL LATTICE TYPE (PRESENT INVENTION) | SEQUENTIAL OPTIMIZATION (FIGS. 6 AND 8) | 0 | 1 | 2 | 3 |
| | SIMULTANEOUS OPTIMIZATION (FIGS. 9 AND 10) | 0 | 2 | 2 | 4 |
| | HOUSEHOLDER ORTHOGONALIZATION TRANSFORM (FIG. 20) | 0 | 1 | 2 | 3 |
| | GRAM-SCHMIDT ORTHOGONALIZATION TRANSFORM (FIG. 18) | 0 | 1 | 2 | 3 |

Referring to the above Table, if N=60, as an example, is set for the N-dimensional sparse code vectors, 500 to 600 multiplications are required. Assuming here that 1024 code vectors are loaded as standard in the codebook, a computation amount of about 12 million/-sec is needed for a search of one code vector in the above case of N=60. This computation amount is not comparable with that of a usual IC processor.

Contrary to the above, the use of the hexagonal lattice codebook according to the present invention can drastically reduce the multiplication number to about 1/200.

Figure 22:
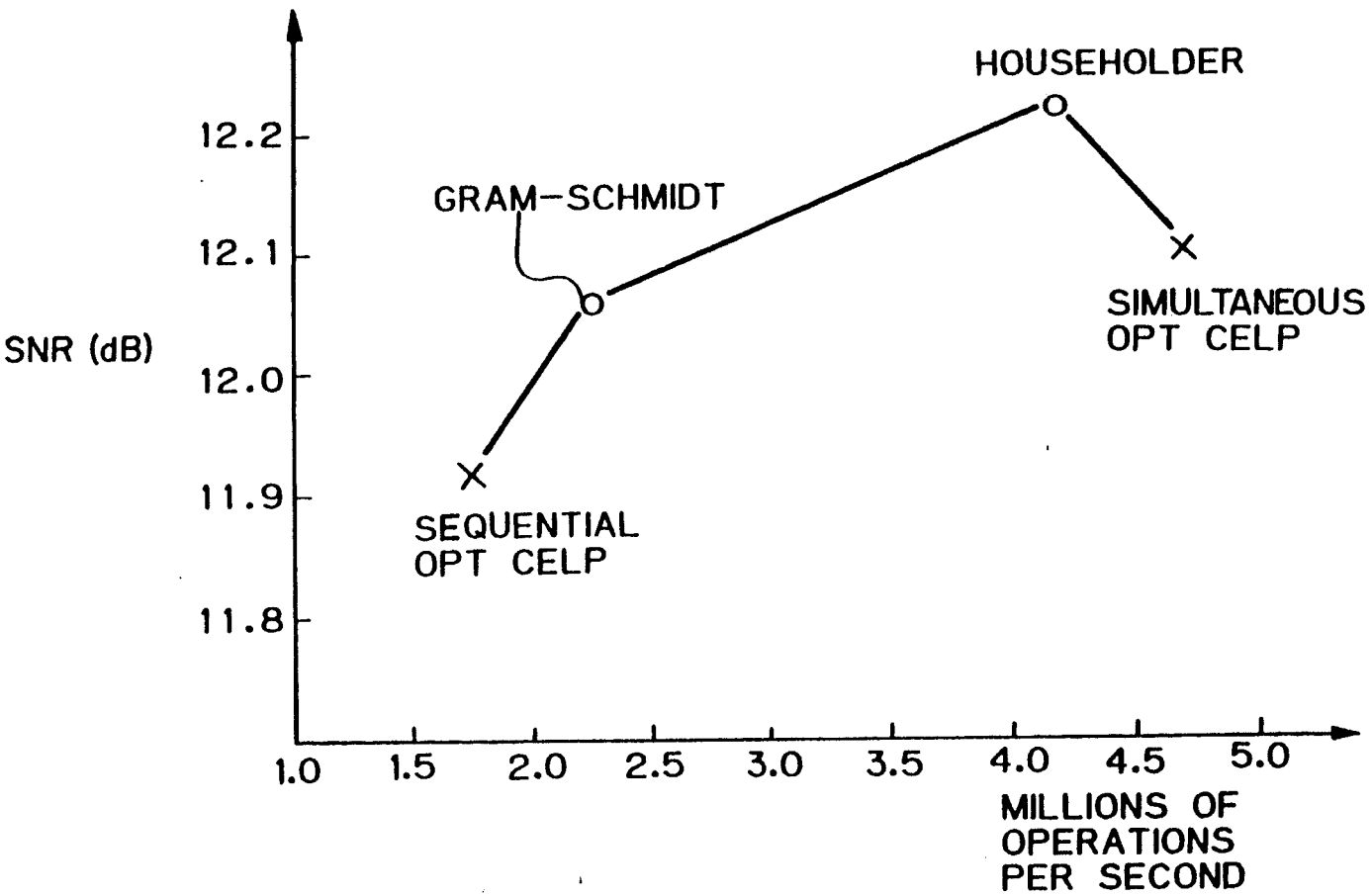
FIG. 22 depicts a graph of a speech quality vs computational complexity.

FIG. 22 depicts a graph of speech quality vs computational complexity. As mentioned previously, the hexagonal lattice vector codebook of the present invention is most preferably applied to the orthogonalization transform CELP coding. In the graph, ×symbols represent the characteristics under the conventional sequential optimization (OPT) CELP coding and the conventional simultaneous optimization (OPT) CELP coding, and o symbols represent the characteristics under the Gram-Schmidt and householder orthogonalization transform CELP codings. Four symbols are measured with the use of the hexagonal lattice vector codebook 20. In the graph, the abscissa indicates millions of operations per second, where $$1\ operation = 1 multiply-accumulate$$

=1 compare=0.1 division=0.1 square root stand. Namely, 1 operation is equivalent to 1 multiply-accumulate, one comparison, i.e., <or >, one 0.1 division (÷) (1 division=10 operations) and one 0.1 square root, i.e., √. The ordinate thereof indicates a sequential SNR in computer Simulation (dB). As can be seen in the graph, the computation amount required in the Gram-Schmidt orthogonalization and householder transform CELP coding systems is larger than that required in the sequential optimization CELP coding system, but the former two systems give a better speech reproduction quality than that produced by the latter system.

From the viewpoint of the computation amount, the Gram-Schmidt transform is superior to the householder transform, but from the viewpoint of the quality (SNR), the householder transform is the best among the variety of CELP coding methods.

I claim:

1. A speech coding system constructed under a code-excited linear prediction (CELP) coding algorithm, including:

an adaptive codebook storing therein a plurality of pitch prediction residual vectors and providing an output;

a sparse-stochastic codebook storing therein, as white noise, a plurality of code vectors and providing an output;

first and second gain amplifiers, respectively coupled to said adaptive codebook and said sparse-stochastic codebook, for applying a first gain and a second gain to the outputs from said adaptive and sparse-stochastic codebooks respectively; and an evaluation unit, coupled to said adaptive and sparse-stochastic codebooks, for selecting optimum vectors and optimum gains which match a perceptually weighted input speech signal, to provide the selected optimum vectors and optimum gains as coded information for each input speech signal, said sparse-stochastic codebook being formed as a hexagonal lattice code vector stochastic codebook in which particular code vectors are loaded, said code vectors being hexagonal lattice code vectors each consisting of a zero vector with one sample set to +1 and another sample set to −1.

2. A speech coding system as set forth in claim 1, wherein each said hexagonal lattice code vector (C) is used in a form of $$C_{n,m} = [e_n - e_m]$$

where e represents a unit vector, the vector C is also used in a form of AC which is obtained by multiplying a perceptually weighted N-dimensional matrix A with the vector C, where A is expressed as $$A = [A_1, A_2 - A_N]$$

so that the vector AC is calculated by first taking out two elements $A_n$ and $A_m$ from the N-dimensional matrix A and then subtracting one from the other.

3. A speech coding system as set forth in claim 2, wherein said hexagonal lattice code vector stochastic codebook is incorporated into said coding system operated under a sequential optimization CELP coding algorithm, and said evaluation unit comprises:

a first evaluation unit coupled to said adaptive codebook, which selects the optimum pitch prediction residual vector from said adaptive codebook and selects the corresponding optimum first gain such that the optimum pitch prediction residual vector can minimize the power of a pitch prediction error signal vector which is an error vector between the perceptually weighted input speech signal vector and a pitch prediction reproduced signal obtained by applying the perceptual weighting and said gain to each said pitch prediction residual vector of said adaptive codebook; and a second evaluation unit coupled to said hexagonal lattice code vector stochastic codebook which selects the optimum code vector from said hexagonal lattice code vector stochastic codebook and selects the corresponding optimum second gain such that the optimum code vector can minimize the power of an error signal vector between said pitch prediction error signal vector and a linear prediction reproduced signal obtained by applying the perceptual weighting and said gain to each said code vector of said hexagonal lattice code vector stochastic codebook.

4. A speech coding system as set forth in claim 3, wherein said system further comprises:

arithmetic processing means for calculating a time-reversed perceptually weighted pitch prediction error signal vector from said pitch prediction error signal vector;

a multiplying unit coupled to said arithmetic processing means, which multiplies said time-reversed perceptually weighted pitch prediction error signal vector with each code vector of sad hexagonal lattice code vector stochastic codebook to produce a correlation value between the above two vectors; and a filter operation unit coupled to said hexagonal lattice code vector stochastic codebook which finds an autocorrelation value of the reproduced code vector obtained by applying the perceptual weighting to each said code vector of said hexagonal lattice code vector stochastic codebook, wherein said second evaluation unit selects the optimum code vector and the corresponding optimum gain such that the optimum code vector can minimize the power of the error signal vector, based on the above two correlation values, with respect to said pitch prediction error signal vector.

5. A speech coding system as set forth in claim 2, wherein said hexagonal lattice code vector stochastic codebook is incorporated into said coding system operated under a simultaneous optimization CELP coding algorithm, said evaluation unit which selects the optimum code vector from the codebook and selects the corresponding optimum first and second gains such that the optimum code vector can minimize the power of an error signal vector between the perceptually weighted input speech signal vector and a reproduced signal vector which is a sum of a pitch prediction reproduced signal vector and a linear prediction signal vector, where the pitch prediction reproduced signal vector is obtained by applying the perceptual weighting and the gain to each said pitch prediction residual vector of said adaptive codebook, and the vector is obtained by applying the perceptual weighting and the gain to each code vector of said hexagonal lattice code vector stochastic codebook.

6. A speech coding system as set forth in claim 5, further comprising:

first arithmetic processing means for calculating a time-reversed perceptually weighted input speed signal vector from said perceptually weighted input speech signal vector;

second arithmetic processing means for calculating a time-reversed perceptually weighted pitch prediction vector from the perceptually weighted pitch prediction vector which corresponds to said pitch prediction reproduced signal but is not multiplied by the gain;

a first multiplying unit coupled to said first arithmetic processing means, which generates a correlation value between two vectors by multiplying said time-reversed perceptually weighted input speech signal vector with each said code vector of said hexagonal lattice code vector stochastic codebook;

a second multiplying unit coupled to said second arithmetic processing means, which generates a correlation value between two vectors by multiplying said time-reversed perceptually weighted pitch prediction vector with each said code vector of said hexagonal lattice code vector stochastic codebook; and a filter operation unit coupled to said hexagonal lattice code vector stochastic notebook, which finds an autocorrelation value of the reproduced code vector obtained by applying the perceptual weighting to each said code vector of said hexagonal lattice code vector stochastic codebook, wherein said evaluation unit selects the optimum code vector and the corresponding optimum gains such that the optimum code vector can minimize the power of the error signal vector based on all of the above correlation values.

7. A speech coding system as set forth in claim 2, wherein said hexagonal lattice code vector stochastic codebook is incorporated into said coding system operated under an orthogonalization transform CELP coding algorithm, wherein said evaluation unit comprises:

a first evaluation unit coupled to said adaptive codebook, which selects the optimum pitch prediction residual vector from said adaptive codebook and selects the corresponding optimum first gain such that the optimum pitch prediction residual vector can minimize the power f the pitch prediction error signal vector which is an error vector between the perceptually weighted input speech signal vector and a pitch prediction reproduced signal obtained by applying the perceptual weighting and said gain to each said pitch prediction residual vector of said adaptive codebook;

a weighted orthogonalization transforming unit coupled to said hexagonal lattice code vector stochastic codebook, which transforms each said code vector of said hexagonal lattice code vector codebook into an orthogonal perceptually weighted reproduced code vector which is made orthogonal to said optimum perceptually weighted pitch prediction vector; and a second evaluation unit coupled to said weighted orthogonalization transforming unit, which selects the optimum code vector from the codebook and selects the corresponding optimum second gain such that the optimum code vector can minimize the power of a linear prediction error signal vector between the perceptually weighted input speech signal vector and a linear prediction reproduced signal which is generated by multiplying said gain by said orthogonal perceptually weighted reproduced code vector.

8. A speech coding system as set forth in claim 7, wherein said system further comprises:

arithmetic processing means for calculating a time-reversed perceptually weighted input speech signal vector from said perceptually weighted input speech signal vector;

a time-reversed orthogonalization transforming unit coupled to said arithmetic processing means, which produces a time-reversed perceptually weighted orthogonally transformed input speech signal vector with respect to the optimum perceptually weighted pitch prediction vector;

a multiplying unit coupled to said time-reversed orthogonalization transforming unit, which generates a correlation value between two vectors by multiplying said time-reversed perceptually weighted orthogonally transformed input speech signal vector with each said code vector of said hexagonal lattice code vector stochastic codebook;

an orthogonalization transforming unit which calculates a perceptually weighted orthogonally transformed code vector relative to the optimum pitch prediction residual vector; and a multiplying unit coupled to said orthogonalization transforming unit, which finds an autocorrelation value of said perceptually weighted orthogonally transformed code vector;

wherein said evaluation unit selects the optimum code vector and the corresponding optimum gain such that the optimum code vector can minimize the power of the error signal vector, based on the above two correlation values, with respect to the perceptually weighted input speech signal vector.

9. A speech coding system as set forth in claim 8, wherein said system is comprised of:

arithmetic processing means for calculating a time-reversed perceptually weighted input speech signal vector from said perceptually weighted input speech signal vector;

a time-reversed orthogonalization transforming unit coupled to said arithmetic processing means, which produces a time-reversed perceptually weighted orthogonally transformed input speech signal vector with respect to the optimum perceptually weighted pitch prediction vector;

a multiplying unit coupled to said time-reversed orthogonalizaton transforming unit, which generates a correlation value between two vectors by multiplying said time-reversed perceptually weighted orthogonally transformed input speech signal vector with each said code vector of said hexagonal lattice code vector stochastic codebook; and an orthogonalization transforming unit coupled to said hexagonal lattice code vector stochastic codebook which receives an autocorrelation matrix, which is renewed at every frame, of the time-reversed transforming matrix produced by said arithmetic processing means and said time-reversed orthogonalization transforming unit, takes out three elements which define each said code vector of said hexagonal lattice code vector stochastic codebook from said matrix and calculates an autocorrelation value of the code vector which is perceptually weighted and orthogonally transformed relative to the optimum perceptually weighted pitch prediction vector;

wherein said evaluation unit selects the optimum code vector and the corresponding optimum gain such that the optimum code vector can minimize the power of the error signal vector, based on the above two correlation values, with respect to the perceptually weighted input speech signal vector.

10. A speech coding system, comprising:

an adaptive codebook storing therein a plurality of pitch prediction residual vectors and providing an output;

a sparse-stochastic codebook storing therein a plurality of code vectors formed as multi-dimensional polyhedral lattice vectors each consisting of a zero vector with one sample set to $+1$ and another sample set to $-1$, said sparse-stochastic codebook providing an output; and an evaluation unit, coupled to said adaptive and sparse-stochastic codebooks, for selecting optimum vectors and optimum gains which match a perceptually weighted input speech signal, to provide the selected optimum vectors and optimum gains as coded information for each input speech signal.

* * * * *

UNITED STATES PATENT AND TRADEMARK OFFICE

CERTIFICATE OF CORRECTION

PATENT NO. : 5,245,662

DATED : SEPTEMBER 14, 1993

INVENTOR(S) : TOMOHIKO TANIGUCHI ET AL.

It is certified that error appears in the above-indentified patent and that said Letters Patent is hereby corrected as shown below:

Col. 5, line 37, (formula (5)), "/e" should be --/ê--;
line 38, (formula (5)), "/e" should be --/ê--;
line 40, (formula (5)), " e" should be --/ê--.

Col. 7, line 29, "AC = Aen" should be --AC = $Ae_n$--.

Col. 9, line 56, "is" should be --This is--;
line 67, "$^t$(AH-" should be --$^t$(AH)- --;
line 68, ")AH," should be --AH,--.

Col. 13, line 36, "$^t$(AH-" should be --$^t$(AH)- --;
line 37, ")AX)." should be --AX).--;
line 44, "C = C" should be --C′ = C--;
line 50, "H = $CC^{-1}$" should be --H - $C'C^{-1}$--.

Col. 14, line 40, "$^t$(AH-" should be --$^t$(AH)- --;
line 41, ")AH," should be --AH,--;
line 51, "$^t$(AC)AC" should be --$^t$(AC′)AC--.

UNITED STATES PATENT AND TRADEMARK OFFICE

CERTIFICATE OF CORRECTION

PATENT NO. : 5,245,662

DATED : SEPTEMBER 14, 1993

INVENTOR(S) : TOMOHIKO TANIGUCHI ET AL

It is certified that error appears in the above-indentified patent and that said Letters Patent is hereby corrected as shown below:

Col. 18, line 57, "f" should be --of--.

Signed and Sealed this

Seventeenth Day of May, 1994

Bruce Lehman

*Attest:*

BRUCE LEHMAN

*Attesting Officer*

*Commissioner of Patents and Trademarks*